US009401537B2

(12) United States Patent
Hendry et al.

(10) Patent No.: US 9,401,537 B2
(45) Date of Patent: Jul. 26, 2016

(54) MULTI-MODE FILTER

(75) Inventors: David Robert Hendry, Brisbane (AU); Steven John Cooper, Brisbane (AU); Peter Blakeborough Kenington, Chepstow (GB)

(73) Assignee: Mesaplexx Pty Ltd., Queensland (AU)

( * ) Notice: Subject to any disclaimer, the term of this patent is extended or adjusted under 35 U.S.C. 154(b) by 510 days.

(21) Appl. No.: 13/593,149

(22) Filed: Aug. 23, 2012

(65) Prior Publication Data

US 2013/0053104 A1 Feb. 28, 2013

Related U.S. Application Data

(60) Provisional application No. 61/531,277, filed on Sep. 6, 2011.

(30) Foreign Application Priority Data

Aug. 23, 2011 (AU) ..... 2011903389

(51) Int. Cl.
*H01P 1/20* (2006.01)
*H01P 7/10* (2006.01)
*H01P 1/208* (2006.01)

(52) U.S. Cl.
CPC ..... *H01P 7/105* (2013.01); *H01P 1/2088* (2013.01); *H01P 1/2002* (2013.01); *Y10T 29/49016* (2015.01)

(58) Field of Classification Search
CPC ..... H01P 1/2002; H01P 1/2086; H01P 7/105
USPC ..... 333/202, 219.1
See application file for complete search history.

(56) References Cited

U.S. PATENT DOCUMENTS 2,890,421 A 6/1959 Currie
3,657,670 A 4/1972 Kitazume et al. ..... 333/73 W (Continued)

FOREIGN PATENT DOCUMENTS

CA 1189154 A2 6/1985
CA 1194157 A1 9/1985

(Continued)

OTHER PUBLICATIONS

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

(Continued)

*Primary Examiner* — Robert Pascal
*Assistant Examiner* — Gerald Stevens
(74) *Attorney, Agent, or Firm* — Harrington & Smith

(57) ABSTRACT

A multi-mode cavity filter comprises a dielectric body having at least first and second orthogonal resonant modes; a first coupling element formed on a first face of the dielectric body for coupling energy to at least a first resonant mode; and a second coupling element formed on the first face of the dielectric body for coupling energy from the at least a first resonant mode. The dielectric body is capable of supporting a first coupling path between the first coupling element and the second coupling element via the at least a first resonant mode and a second coupling path between the first coupling element and the second coupling element, the second coupling path being such that at least partial cancellation of at least some coupled energy takes place so as to form a zero in a response of the filter.

22 Claims, 21 Drawing Sheets

(56) References Cited

U.S. PATENT DOCUMENTS

| | | | | |
|---|---|---|---|---|
| 4,142,164 | A | 2/1979 | Nishikawa et al. | |
| 4,614,920 | A | 9/1986 | Tong | |
| 4,622,523 | A | 11/1986 | Tang | |
| 4,623,857 | A | 11/1986 | Nishikawa et al. | |
| 4,630,009 | A | 12/1986 | Tang | |
| 4,644,305 | A | 2/1987 | Tang et al. | |
| 4,675,630 | A | 6/1987 | Tang et al. | |
| 4,792,771 | A | 12/1988 | Siu | |
| 4,879,533 | A | 11/1989 | de Muro et al. | 333/206 |
| 4,963,844 | A * | 10/1990 | Konishi et al. | 333/208 |
| 5,023,866 | A | 6/1991 | De Muro | 370/24 |
| 5,307,036 | A | 4/1994 | Turunen et al. | 333/202 |
| 5,325,077 | A | 6/1994 | Ishikawa et al. | 333/219.1 |
| 5,585,331 | A | 12/1996 | Mansour et al. | |
| 5,589,807 | A | 12/1996 | Tang | |
| 5,710,530 | A | 1/1998 | Wada et al. | |
| 5,731,751 | A | 3/1998 | Vangala | |
| 5,805,035 | A | 9/1998 | Accatino et al. | |
| 5,821,837 | A | 10/1998 | Accatino et al. | |
| 6,005,457 | A | 12/1999 | Wu | |
| 6,016,091 | A | 1/2000 | Hidaka et al. | 333/202 |
| 6,025,291 | A | 2/2000 | Murakawa | 501/136 |
| 6,066,996 | A | 5/2000 | Goertz et al. | |
| 6,072,378 | A | 6/2000 | Kurisu et al. | |
| 6,133,808 | A | 10/2000 | Arakawa | 333/134 |
| 6,160,463 | A | 12/2000 | Arakawa et al. | 333/202 |
| 6,278,344 | B1 | 8/2001 | Kurisu et al. | |
| 6,346,867 | B2 | 2/2002 | Arakawa et al. | 333/208 |
| 6,462,629 | B1 | 10/2002 | Blair et al. | |
| 6,549,094 | B2 | 4/2003 | Takagi et al. | 333/134 |
| 6,677,837 | B2 | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 6,834,429 | B2 | 12/2004 | Blair et al. | |
| 6,853,271 | B2 | 2/2005 | Wilber et al. | |
| 6,897,741 | B2 | 5/2005 | Ando et al. | |
| 6,954,122 | B2 | 10/2005 | Wilber et al. | |
| 7,042,314 | B2 | 5/2006 | Wang et al. | 333/202 |
| 7,068,127 | B2 | 6/2006 | Wilber et al. | |
| 7,138,891 | B2 | 11/2006 | Andoh et al. | |
| 7,605,678 | B2 | 10/2009 | Ando et al. | |
| 7,755,456 | B2 | 7/2010 | Salehi | |
| 8,022,792 | B2 | 9/2011 | Howard | |
| 8,325,077 | B2 | 12/2012 | Gentric | 341/173 |
| 2001/0000429 | A1 * | 4/2001 | Arakawa et al. | 333/208 |
| 2001/0024147 | A1 | 9/2001 | Arakawa et al. | 333/135 |
| 2002/0024410 | A1 * | 2/2002 | Guglielmi et al. | 333/202 |
| 2002/0039058 | A1 | 4/2002 | Sano et al. | 333/202 |
| 2003/0006864 | A1 | 1/2003 | Hattori et al. | 333/202 |
| 2003/0090344 | A1 | 5/2003 | Wang et al. | 333/202 |
| 2003/0141948 | A1 | 7/2003 | Maekawa et al. | |
| 2003/0227360 | A1 | 12/2003 | Kirihara et al. | 333/239 |
| 2004/0041660 | A1 | 3/2004 | Kawahara et al. | |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | 333/202 |
| 2008/0018391 | A1 | 1/2008 | Bates | 333/557 |
| 2008/0061905 | A1 | 3/2008 | Ishikawa | |
| 2008/0211601 | A1 | 9/2008 | Bates | 333/186 |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |
| 2014/0077900 | A1 | 3/2014 | Rogozine et al. | 333/212 |

FOREIGN PATENT DOCUMENTS

| | | | |
|---|---|---|---|
| EP | 0883203 | A3 | 10/1999 |
| JP | H0216801 | | 1/1990 |
| JP | H-10284988 | | 1/1998 |
| JP | H-1079636 | | 3/1998 |
| JP | H-10209808 | | 8/1998 |
| JP | H-10224113 | | 8/1998 |
| JP | H-10294644 | | 11/1998 |
| JP | H-10322161 | | 12/1998 |
| JP | 2000295072 | A | 10/2000 |
| JP | 2001060804 | A | 3/2001 |
| JP | 2001060805 | A | 3/2001 |
| JP | 2001160702 | A | 6/2001 |
| JP | 2002135003 | A | 5/2002 |
| JP | 2002151906 | A | 5/2002 |
| JP | 2002217663 | A | 8/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223721 | A | 8/2005 |
| WO | WO-9301626 | A1 | 1/1993 |
| WO | WO-0077883 | A1 | 12/2000 |
| WO | WO-02078119 | A1 | 10/2002 |

OTHER PUBLICATIONS

Awai, Ikuo, et al; Coupling of Dual Modes in a Dielectric Waveguide Resonator and its Application to Bandpass Filters; Proceedings of the 25th European Microwave Conference; (1995); pp. 533-537; Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Faculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40th European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectric Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430; vol. 56; No. 2.

Dupont, "Properties Handbook", Dupont, p. 4 (30 pgs.), Nov. 2003.

Trak Ceramics, "Dielectric Materials", Trak Ceramics, Inc., p. 1 (8 pgs.).

* cited by examiner

MULTI-MODE FILTER

CROSS-REFERENCE TO RELATED APPLICATIONS

The present application is related to and claims the benefit of Australian Provisional Patent Application No. 2011903389, filed Aug. 23, 2011 and U.S. Provisional Patent Application No. 61/531,277, filed Sep. 6, 2011, both of whose disclosures are hereby incorporated by reference in their entirety into the present disclosure.

TECHNICAL FIELD

The present invention relates to a multi-mode filter.

BACKGROUND

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topology does not have to match the topology of the real filter.

Conventional single-mode filters formed from dielectric resonators are known. Dielectric resonators have high-Q (low loss) characteristics which enable highly selective filters having a reduced size compared to cavity filters. These single-mode filters tend, in use, to be provided in series as a cascade of separated physical dielectric resonators, with various couplings between them and to the input/output ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are often coupled together by providing openings between cavities in which the resonators are located. Typically, the resonators provide transmission "poles" or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, the latter of which is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314 this may be achieved using a waveguide or aperture for providing coupling between two resonator mono-bodies. Another approach includes using a single-mode comb-line resonator coupled between two dielectric mono-bodies to form a hybrid filter assembly as described in U.S. Pat. No. 6,954,122. In any case the physical complexity and hence manufacturing costs are even further increased.

SUMMARY OF INVENTION

According to a first aspect, the invention provides a multi-mode dielectric filter, comprising: a dielectric body having at least first and second orthogonal resonant modes; a first coupling element formed on a first face of the dielectric body for coupling energy to at least a first resonant mode; a second coupling element formed on the first face of the dielectric body for coupling energy from the at least a first resonant mode; wherein the dielectric body is capable of supporting a first coupling path between the first coupling element and the second coupling element via the at least a first resonant mode; and wherein the dielectric body is capable of supporting a second coupling path between the first coupling element and the second coupling element, the second coupling path being such that at least partial cancellation of at least some coupled energy takes place so as to form a zero in a response of the filter. The first coupling element may comprise a first portion having a longitudinal axis extending in a first direction, and a second portion having a longitudinal axis extending in a second direction. The second direction may be substantially orthogonal to the first direction.

The second coupling element may comprise a third portion having a longitudinal axis extending in a first direction, and a fourth portion having a longitudinal axis extending in a second direction.

The first coupling element may comprise a first portion having a longitudinal axis extending in a first direction, and a second portion having a longitudinal axis extending in a second direction. The second coupling element may comprise a third portion having a longitudinal axis extending parallel to the first direction, and a fourth portion having a longitudinal axis extending parallel to the second direction. Alternatively, the second coupling element may comprise a third portion having a longitudinal axis extending perpendicular to the first direction, and a fourth portion having a longitudinal axis extending parallel to the second direction. Alternatively, the second coupling element may comprise a third portion having a longitudinal axis extending parallel to the first direction, and a fourth portion having a longitudinal axis extending perpendicular to the second direction.

The dielectric body is may be a three-dimensional body having at least two faces, and the second and subsequent faces may be covered by a metallic layer.

The first coupling element, in use, may be a resonant element.

The dielectric body may be capable of supporting the second coupling path between the first coupling element and the second coupling element via at least a second resonant mode or between the first coupling element and the second coupling element via at least a third resonant mode.

The first coupling element may be an input coupling element for coupling a signal to the dielectric body, and the second coupling element may be an output coupling element for coupling a signal out of the dielectric body. The first and second coupling elements may be tracks. A first end of at least one of the tracks may be coupled to a ground-plane. A second end of at least one of the tracks may be configured to couple energy to a third resonant mode of the resonator body. A second end of each track may include a signal feed-point.

The first coupling element and the second coupling element may be substantially L-shaped.

The filter may further comprise a third coupling element for coupling the first coupling element to the second coupling element.

The dielectric body may have first, second and third orthogonal resonant modes. The first mode may be an X-mode, the second mode may be a Y-mode and the third mode may be a Z-mode.

The first coupling path may exist between the first coupling element and the second coupling element predominantly via the at least a first resonant mode. The second coupling path may exist between the first coupling element and the second coupling element predominantly via the at least a second resonant mode. A third coupling path may exist between the first coupling element and the second coupling element predominantly via the at least a third resonant mode. A fourth coupling path may exist predominantly directly between the first coupling element and the second coupling element The filter may further comprise a second dielectric body coupled in series with the dielectric body.

According to a second aspect, the invention provides a method of designing a multi-mode dielectric filter, the filter comprising a dielectric body having at least first and second orthogonal resonant modes, the method comprising the steps of: providing a first coupling element on a first face of the dielectric body for coupling energy to at least a first resonant mode; and providing a second coupling element on the first face of the dielectric body for coupling energy from the at least a first resonant mode; wherein a first coupling path can exist between the first coupling element and the second coupling element via the at least a first resonant mode; and wherein a second coupling path can exist between the first coupling element and the second coupling element, the second coupling path being such that at least partial cancellation of at least some coupled energy takes place so as to form a zero in a response of the filter.

The method may further comprise the step of providing a third coupling element for coupling the first coupling element to the second coupling element.

According to a third aspect, the invention provides a multi-mode filter comprising: a first dielectric body having a plurality of faces, a first face of the first dielectric body having a first coupling structure thereon for coupling energy to at least a first resonant mode of the dielectric body; and a second dielectric body having a plurality of faces, a first face of the second dielectric body having a second coupling structure thereon for coupling energy to at least the first resonant mode of the dielectric body; wherein the first dielectric body is coupled to the second dielectric body via at least one of said plurality of faces.

A first coupling path may exist between the first coupling structure and the second coupling structure via the at least a first resonant mode. A second coupling path may exist between the first coupling structure and the second coupling structure. The second coupling path may be such that at least partial cancellation of at least some coupled energy takes place so as to form a zero in a response of the filter.

According to a fourth aspect, the invention provides a base station comprising a filter as described herein.

Any of the features discloses in the description or in the claims can be combined with any other of the features unless such a combination is explicitly excluded.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1A:
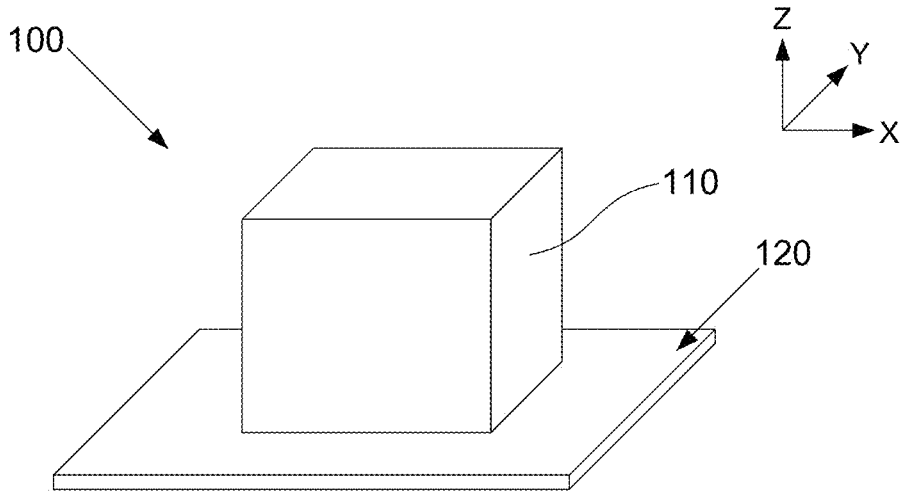
FIG. 1A is a schematic perspective view of an example of a multi-mode filter.
Figure 1B:
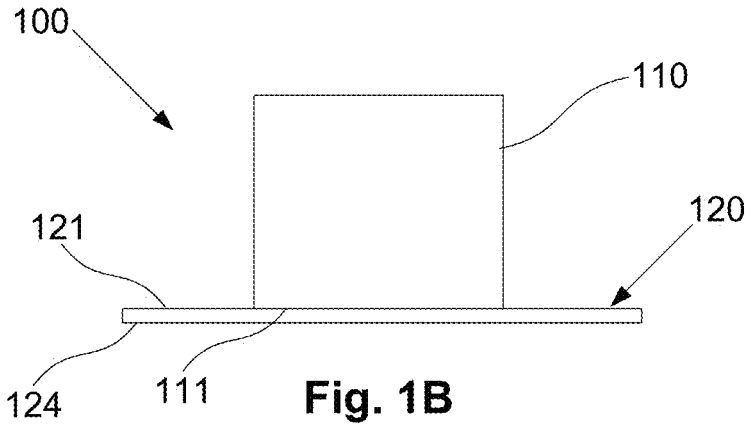
FIG. 1B is a schematic side view of the multi-mode filter of FIG. 1A.
Figure 1C:
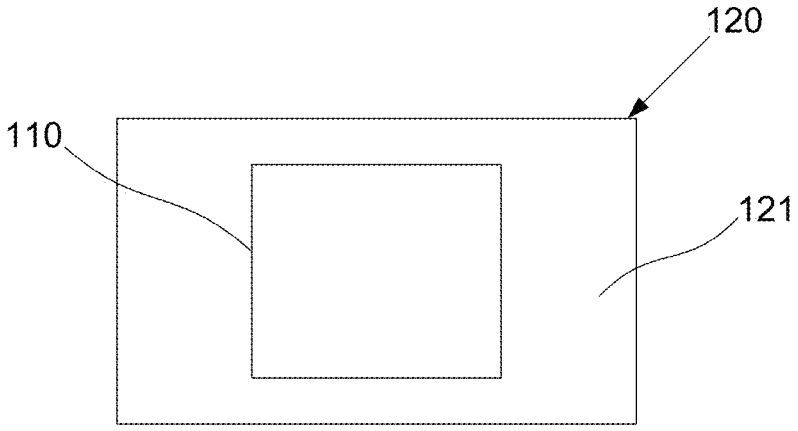
FIG. 1C is a schematic plan view of the multi-mode filter of FIG. 1A.

An example of a multi-mode filter will now be described with reference to FIGS. 1A to 1E.

In this example, the filter 100 includes a resonator body 110, and a coupling structure 130. The coupling structure 130 (FIG. 1D) comprises at least one coupling 131, 132, which includes an electrically conductive coupling path extending adjacent at least part of a first surface 111 of the resonator body 110, so that the coupling structure 130 provides coupling to a plurality of the resonance modes of the resonator body.

In use, a radio frequency signal, containing, say, frequencies from within the 1 MHz to 100 GHz range, can be supplied to or received from the at least one coupling 131, 132. In a suitable configuration, this allows a signal to be filtered to be supplied to the resonator body 110 for filtering, or can allow a filtered signal to be obtained from the resonator body, as will be described in more detail below.

The use of electrically conductive coupling paths 131, 132 extending adjacent to the surface 111 allows the signal to be coupled to a plurality of resonance modes of the resonator body 110. This allows a more simplified configuration of resonator body 110 and coupling structures 130 to be used as compared to traditional arrangements. For example, this avoids the need to have a resonator body including cut-outs or other complicated shapes, as well as avoiding the need for coupling structures that extend into the resonator body. This, in turn, makes the filter cheaper and simpler to manufacture, and can provide enhanced filtering characteristics. In addition, the filter is small in size, typically of the order of 6000 $mm^3$ per resonator body, making the filter apparatus suitable for use at the top of antenna towers.

A number of further features will now be described.

In the above example, the coupling structure 130 includes two couplings 131, 132, coupled to an input 141, an output 142, thereby allowing the couplings to act as input and output couplings respectively. In this instance, a signal supplied via the input 141 couples to the resonance modes of the resonator body 110, so that a filtered signal is obtained via the output 142.

For example, a single coupling 131, 132 may be used if a signal is otherwise coupled to the resonator body 110. This can be achieved if the resonator body 110 is positioned in contact with, and hence is coupled to, another resonator body, thereby allowing signals to be received from or supplied to the other resonator body. Coupling structures may also include more couplings, for example if multiple inputs and/or outputs are to be provided, although alternatively multiple inputs and/or outputs may be coupled to a single coupling, thereby allowing multiple inputs and/or outputs to be accommodated.

Alternatively, multiple coupling structures 130 may be provided, with each coupling structure 130 having one or more couplings. In this instance, different coupling structures can be provided on different surfaces of the resonator body. A further alternative is for a coupling structure to extend over multiple surfaces of the resonator body, with different couplings being provided on different surfaces, or with couplings extending over multiple surfaces. Such arrangements can be used to allow a particular configuration of input and output to be accommodated, for example to meet physical constraints associated with other equipment, or to allow alternative coupling arrangements to be provided. In use, a configuration of the input and output coupling paths 131, 132, along with the configuration of the resonator body 110 controls a degree of coupling with each of the plurality of resonance modes and hence the properties of the filter, such as the frequency response.

The degree of coupling depends on a number of factors, such as a coupling path width, a coupling path length, a coupling path shape, a coupling path direction relative to the resonance modes of the resonator body, a size of the resonator body, a shape of the resonator body and electrical properties of the resonator body. It will therefore be appreciated that the example coupling structure and cube configuration of the resonator body is for the purpose of example only, and is not intended to be limiting. The exact arrangement of the components, including the size and shape of the resonator body 110, and the size, shape, orientation and relative positions of the couplings is determined based on the requirements of the filter, and the desired response of the filter. These factors can be determined using electromagnetic simulation software packages well known to those skilled in the art, such as HFSS by Agilent, Concerto by Vector Fields, EM Studio by CST, COSMOL by FEMLAB and Microwave Office by Applied Wave Research (AWR).

Typically the resonator body 110 includes, and more typically is manufactured from a solid body of a dielectric material having suitable dielectric properties. In one example, the resonator body is a ceramic material, although this is not essential and alternative materials can be used. Additionally, the body can be a multilayered body including, for example, layers of materials having different dielectric properties. In one example, the body can include a core of a dielectric material, and one or more outer layers of different dielectric materials.

The resonator body 110 may have an external coating of conductive material, such as silver, although other materials could be used such as gold, copper, or the like. The conductive material may be applied to one or more surfaces of the body. A region of the surface adjacent the coupling structure may be uncoated to allow coupling of signals to the resonator body.

The resonator body can be any shape, but generally defines at least two orthogonal axes, with the coupling paths extending at least partially in the direction of each axis, to thereby provide coupling to multiple separate resonance modes.

Figure 2A:
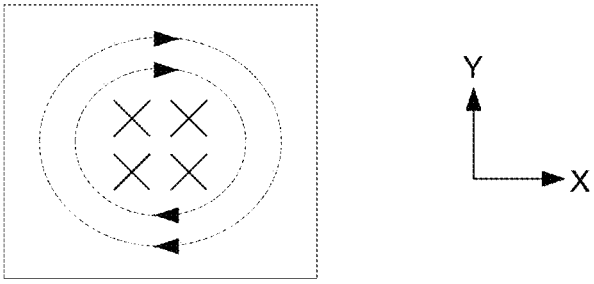
FIGS. 2A to 2C are schematic diagrams of examples the resonance modes of the resonator body of FIG. 1A.
Figure 2B:
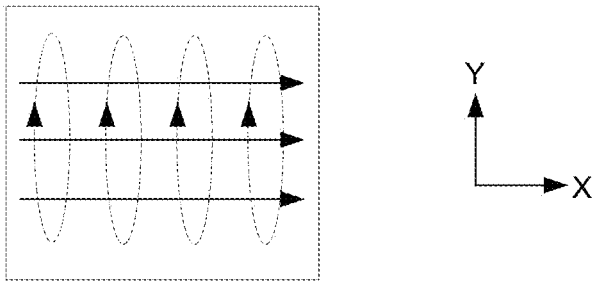
Figure 2C:
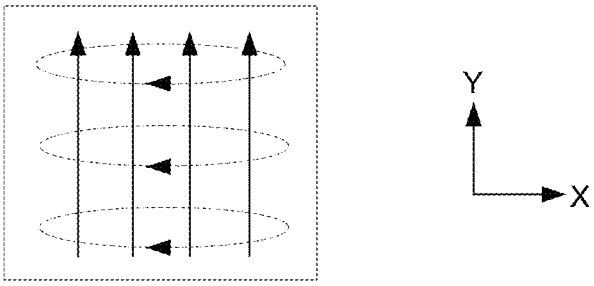

In the current example, the resonator body 110 is a cuboid body, and therefore defines three orthogonal axes substantially aligned with surfaces of the resonator body, as shown in FIG. 1A by the axes X, Y, Z. As a result, the resonator body 110 has three dominant resonance modes that are substantially orthogonal and substantially aligned with the three orthogonal axes. Examples of the different resonance modes are shown in FIGS. 2A to 2C, which show magnetic and electrical fields in dotted and solid lines respectively, with the resonance modes being generally referred to as TM110, TE011 and TE101 modes, respectively.

In this example, each coupling path 131, 132 includes a first path 131.1, 132.1 extending in a direction parallel to a first axis of the resonator body, and a second path 131.2, 132.2, extending in a direction parallel to a second axis orthogonal to the first axis. Each coupling path 131, 132 may also include an electrically conductive coupling patch 131.3, 132.3.

Thus, with the surface 111 provided on an X-Y plane, each coupling includes first and second paths 131.1, 131.2, 132.1, 132.2, extending in a plane parallel to the X-Y plane and in directions parallel to the X and Y axes respectively. This allows the first and second paths 131.1, 131.2, 132.1, 132.2 to couple to first and second resonance modes of the resonator body 110. The optional coupling patch 131.1, 131.2, defines an area extending in the X-Y plane and is for coupling to at least a third mode of the resonator body, as will be described in more detail below.

Figure 10A:
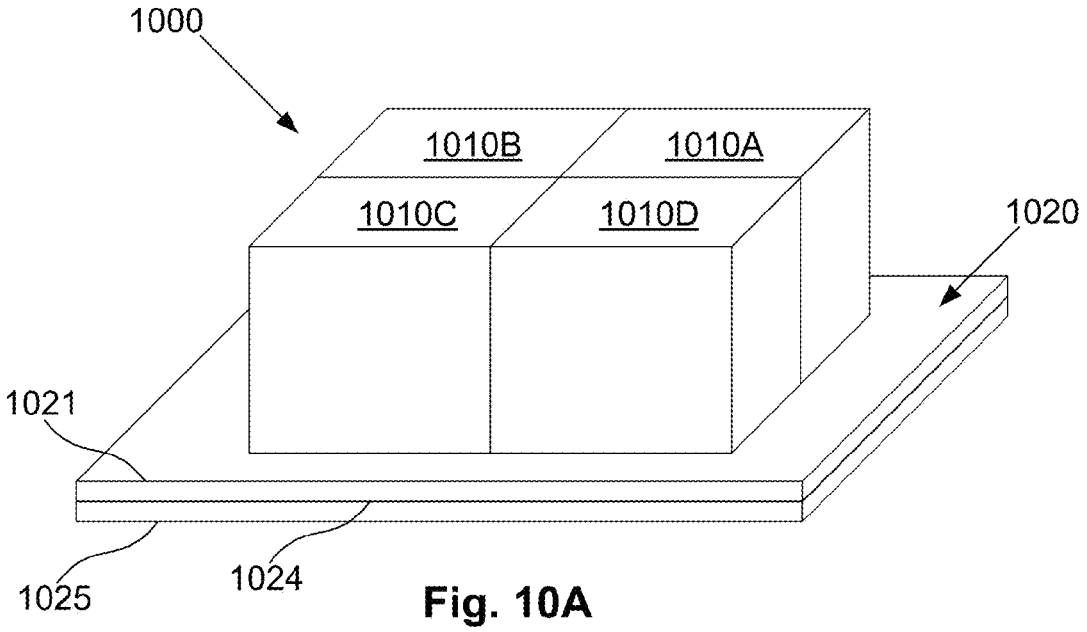
FIG. 10A is a schematic perspective view of an example of a multi-mode filter using multiple resonator bodies to provide filtering for transmit and receive channels.

Cuboid structures are particularly advantageous as they can be easily and cheaply manufactured, and can also be easily fitted together, for example by arranging multiple resonator bodies in contact, as will be described below with reference to FIG. 10A. Cuboid structures typically have clearly defined resonance modes, making configuration of the coupling structure more straightforward. Additionally, the use of a cuboid structure provides a planar surface 111 so that the coupling paths can be arranged in a plane parallel to the planar surface 111, with the coupling paths optionally being in contact with the resonator body 110. This can help maximise coupling between the couplings and resonator body 110, as well as allowing the coupling structure 130 to be more easily manufactured.

For example, the couplings may be provided on a substrate 120. In this instance, the provision of a planar surface 111 allows the substrate 120 to be a planar substrate, such as a printed circuit board (PCB) or the like, allowing the coupling paths 131, 132 to be provided as conductive paths on the PCB. However, alternative arrangements can be used, such as coating the coupling structures onto the resonator body directly.

Figure 1D:
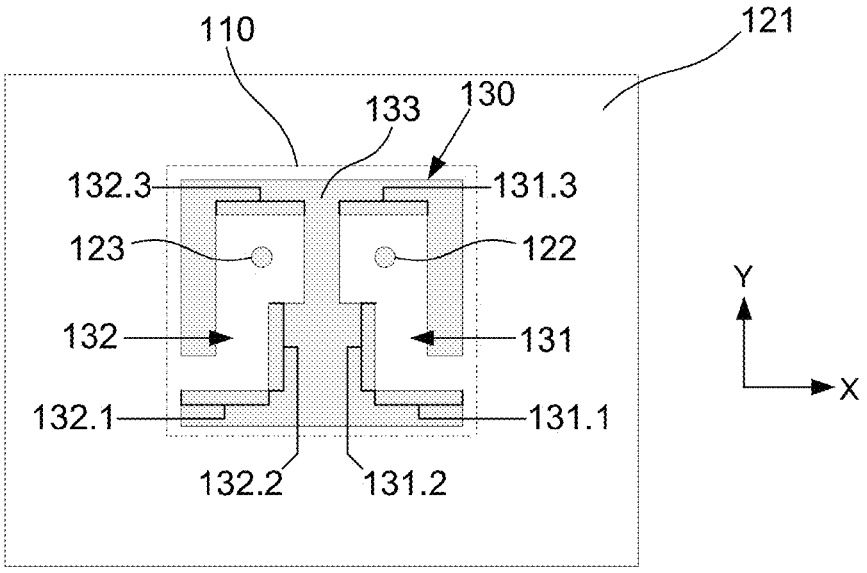
FIG. 1D is a schematic plan view of an example of the substrate of FIG. 1A including a coupling structure.
Figure 1E:
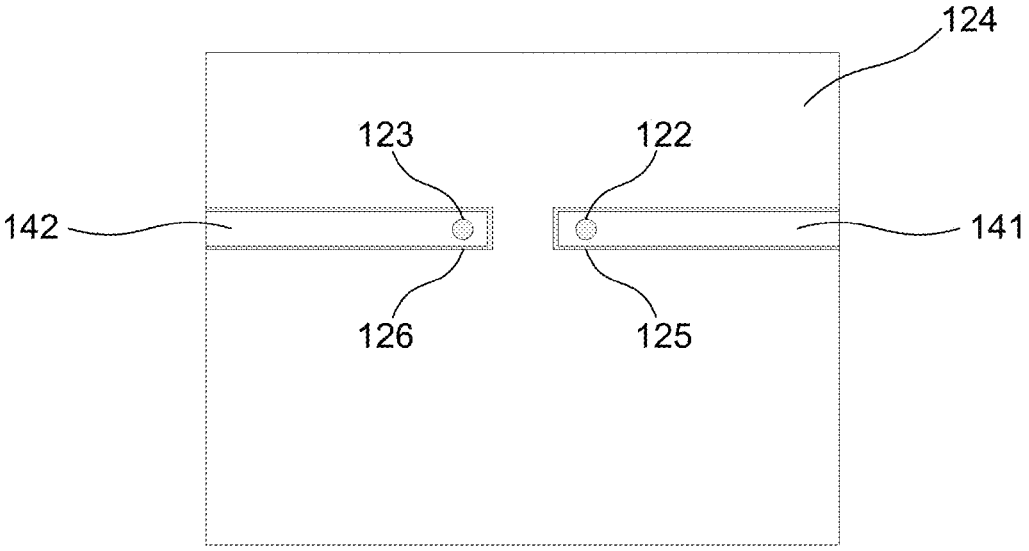
FIG. 1E is a schematic underside view of an example of the substrate of FIG. 1A including inputs and outputs.

In the current example, the substrate 120 includes a ground plane 121, 124 on each side, as shown in FIGS. 1D and 1E respectively. In this example, the coupling paths 131, 132 are defined by a cut-out 133 in the ground plane 121, so that the coupling paths 131, 132 are connected to the ground plane 121 at one end, although this is not essential and alternatively other arrangements may be used. For example, the couplings do not need to be coupled to a ground plane, and alternatively open ended couplings could be used. A further alternative is that a ground plane may not be provided, in which case the coupling paths 131, 132 could be formed from metal tracks applied to the substrate 120. In this instance, the couplings 131, 132 can still be electrically coupled to ground, for example by way of vias or other connections provided on the substrate.

The input and output are provided in the form of conductive paths 141, 142 provided on an underside of the substrate 120, and these are typically defined by cut-outs 125, 126 in the ground plane 124. The input and output may in turn be coupled to additional connections depending on the intended application. For example, the input and output paths 141, 142 could be connected to edge-mount SMA coaxial connectors, direct coaxial cable connections, surface mount coaxial connections, chassis mounted coaxial connectors, or solder pads to allow the filter 100 to be directly soldered to another PCB, with the method chosen depending on the intended application. Alternatively the filter could be integrated into the PCB of other components of a communications system.

In the above example, the input and output paths 141, 142 are provided on an underside of the substrate. However, in this instance, the input and output paths 141, 142 are not enclosed by a ground plane. Accordingly, in an alternative example, a three layered PCB can be used, with the input and output paths embedded as transmission lines inside the PCB, with the top and underside surfaces providing a continuous ground plane, as will be described in more detail below, with respect to the example of FIGS. 8A to 8E. This has the virtue of providing full shielding of the inner parts of the filter, and also allows the filter to be mounted to a conducting or non-conducting surface, as convenient.

The input and output paths 141, 142 can be coupled to the couplings 131, 132 using any suitable technique, such as capacitive or inductive coupling, although in this example, this is achieved using respective electrical connections 122, 123, such as connecting vias, extending through the substrate 120. In this example, the input and output paths 141, 142 are electrically coupled to first ends of the coupling paths, with second ends of the coupling paths being electrically connected to ground.

In use, resonance modes of the resonator body provide respective energy paths between the input and output. Furthermore, the input coupling and the output coupling can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter, as will be described in more detail below. In this regard, the term "zero" refers to a transmission minimum in the frequency response of the filter, meaning transmission of signals at that frequency will be minimal, as will be understood by persons skilled in the art.

Figure 3A:
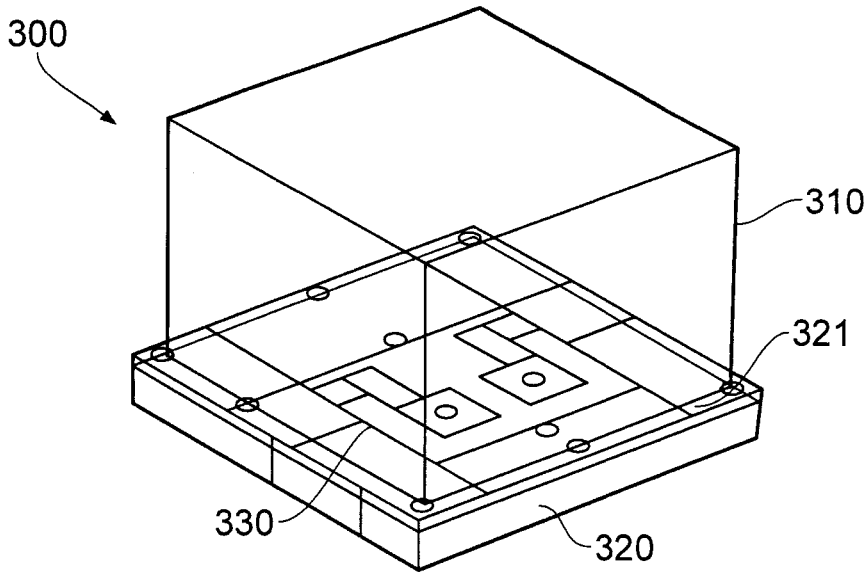
FIG. 3A is a schematic perspective view of an example of a specific configuration of a multi-mode filter.

A specific example filter is shown in FIG. 3A. In this example, the filter 300 includes a resonator body 310 made of 18 mm cubic ceramic body having first to sixth faces. The second to sixth faces are silver coated on 5 sides, while the first face is silvered in a thin band around the perimeter. The sixth side is soldered to a ground plane 321 on an upper side of a PCB 320, so that the coupling structure 330 is positioned against the un-silvered surface of the resonator body 310. Input and output lines on the PCB are implemented as coplanar transmission lines on an underside of the PCB 320 (not shown). It will therefore be appreciated that this arrangement is generally similar to that described above with respect to FIGS. 1A to 1E.

Figure 3B:
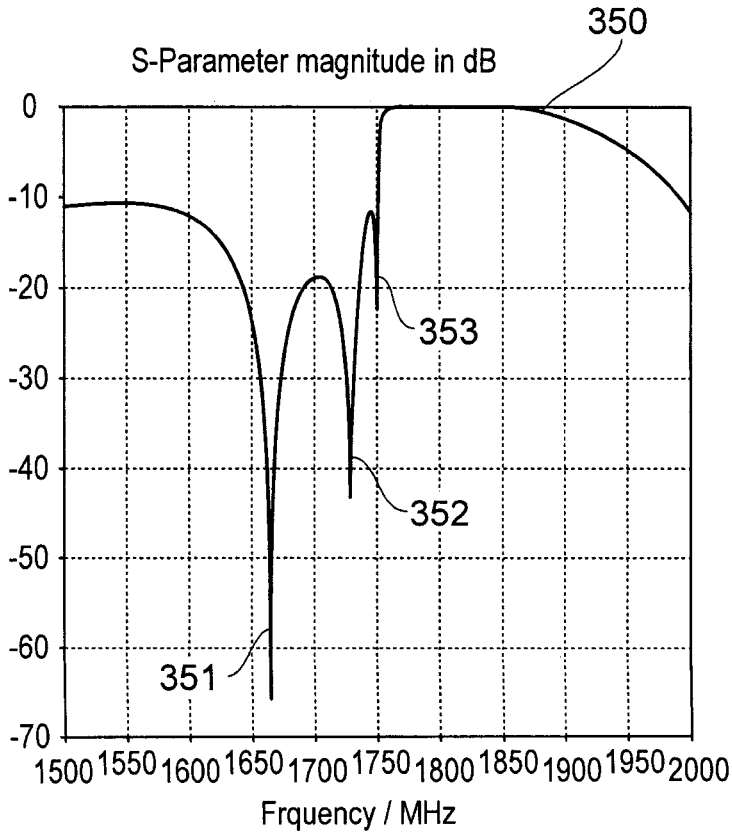
FIG. 3B is a graph of an example of the frequency response of the filter of FIG. 3A.

An example of a calculated frequency response for the filter is shown in FIG. 3B. As shown, the filter 100 can provide three low side zeros 351, 352, 353 adjacent to a sharp transition to a high frequency pass band 350. Alternatively, the filter 100 can provide three high side zeros adjacent to a sharp transition to a lower frequency pass band, described in more detail below with respect to FIG. 9B. When two filters are used in conjunction for transmission and reception, this allows transmit and receive frequencies to be filtered and thereby distinguished, as will be understood by persons skilled in the art.

Example coupling structures will now be described with reference to FIGS. 4A to 4F, together with an explanation of their ability to couple to different modes of a cubic resonator, thereby assisting in understanding the operation of the filter.

Traditional arrangements of coupling structures include a probe extending into the resonator body, as described for example in U.S. Pat. No. 6,853,271. In such arrangements, most of the coupling is capacitive, with some inductive coupling also present due to the changing currents flowing along the probe. If the probe is short, this effect will be small. Whilst such a probe can provide reasonably strong coupling, this tends to be with a single mode only, unless the shape of the coupling structure is modified. For a cubic resonator body, the coupling for each of the modes is typically as shown in Table 1 below.

TABLE 1

| Mode | H field coupling | E field coupling | Notes |
|---|---|---|---|
| TE 011 (E along X) | Negligible or zero due to tiny and orthogonal field. | Negligible or zero due to symmetry. | Negligible coupling |
| TE 101 (E along Y) | Negligible or zero due to tiny and orthogonal field. | Negligible or zero due to symmetry. | Negligible coupling |
| TM 110 (E along Z) | Some for long probe | Strong | Strong coupling |

Furthermore, a probe has the disadvantage of requiring a hole to be bored into the cube.

Figure 4A:
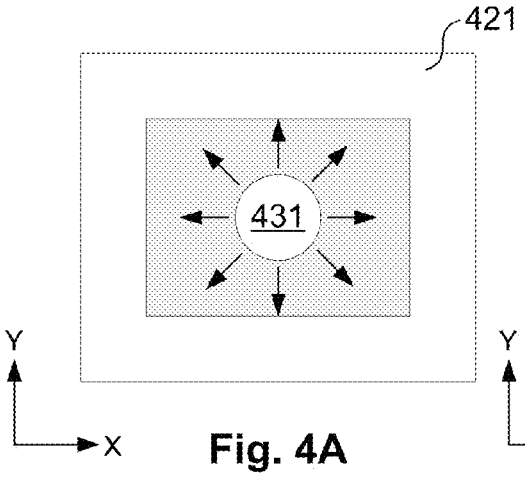
FIGS. 4A and 4B are examples of known coupling structures.

An easier to manufacture (and hence cheaper) alternative is to use a surface patch, as shown for example in FIG. 4A, in which a ground plane 421 is provided together with a coupling 431. In this example, an electric field extending into the resonator body is generated by the patch, as shown by the arrows. The modes of coupling are as summarised in Table 2, and in general this succeeds in only weakly coupling with a single mode. Despite this, coupling into a single mode only can prove useful, for example if multiple couplings are to be provided on different surfaces to each couple only to a single respective mode. This could be used, for example, to allow multiple inputs and or outputs to be provided.

TABLE 2

| Mode | H field coupling | E field coupling | Notes |
|---|---|---|---|
| TE 011 (E along X) | none | Negligible or zero due to symmetry | Negligible coupling |
| TE 101 (E along Y) | none | Negligible or zero due to symmetry | Negligible coupling |
| TM 110 (E along Z) | none | Medium | Medium coupling |

Figure 4B:
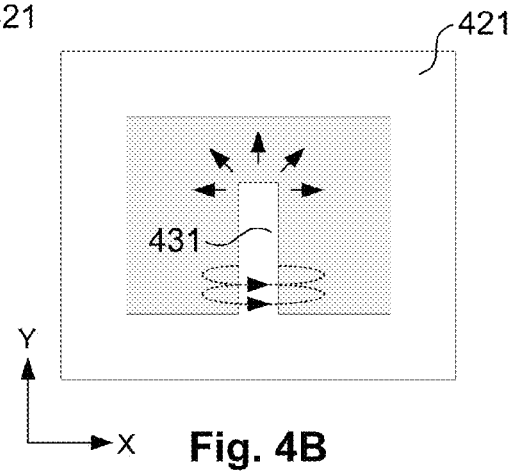

Coupling into two modes can be achieved using a quarter wave resonator, which includes a path extending along a surface of the coupling 431, as shown for example in FIG. 4B. The electric and magnetic fields generated upon application of a signal to the coupling are shown in solid and dotted lines respectively.

In this example, the coupling 431 can achieve strong coupling due to the fact that a current antinode at the grounded end of the coupling produces a strong magnetic field, which can be aligned to match those of at least two resonance modes of the resonator body. There is also a strong voltage antinode at the open circuited end of the coupling, and this produces a strong electric field which couples to the TM110 mode, as summarised below in Table 3.

TABLE 3

| Mode | H field coupling | E field coupling | Notes |
|---|---|---|---|
| TE 011 (E along X) | Weak or zero | Weak or zero | Negligible coupling |
| TE 101 (E along Y) | strong | Weak or zero | Strong coupling |
| TM 110 (E along Z) | strong | medium | Strongest coupling |

Figure 4C:
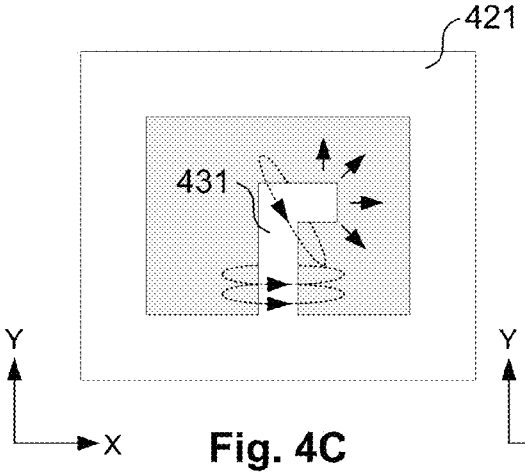
FIGS. 4C to 4F are schematic plan views of example coupling structures constituting embodiments of the invention.

In the example of FIG. 4C, the coupling 431 includes an angled path, meaning a magnetic field is generated at different angles. However, in this arrangement, coupling to both of the TE modes as well as the TM mode still does not occur as eigenmodes of the combined system of resonator cube and input coupling rearrange to minimise the coupling to one of the three eigenmodes.

Figure 4D:
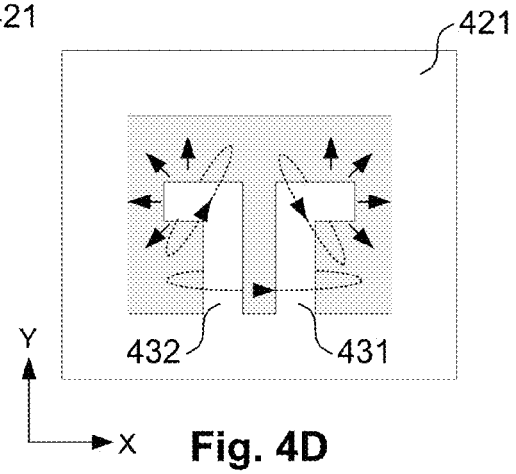
Figure 4E:
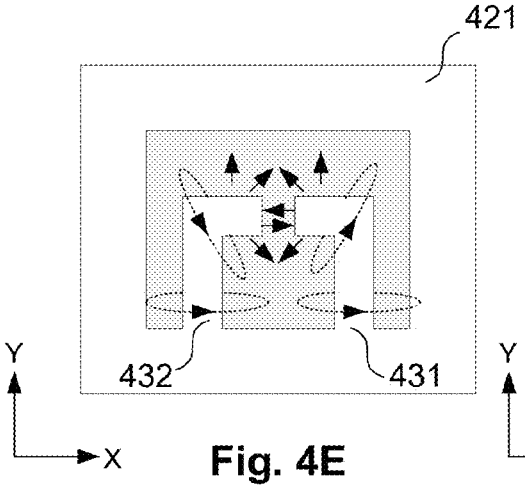

To overcome this, a second coupling 432 can be introduced in addition to the first coupling 431, as shown for example in FIG. 4D. This arrangement avoids minimisation of the coupling and therefore provides strong coupling to each of the three resonance modes. The arrangement not only provides coupling to all three resonance modes for both input and output couplings, but also allows the coupling strengths to be controlled, and provides further input to output coupling.

In this regard, the coupling between the input and output couplings 431, 432 will be partially magnetic and partially electric. These two contributions are opposed in phase, so by altering the relative amounts of magnetic and electric coupling it is possible to vary not just the strength of the coupling but also its polarity.

Thus, in the example of FIG. 4D, the grounded ends of the couplings 431, 432 are close whilst the coupling tips are distant. Consequently, the coupling will be mainly magnetic and hence positive, so that a filter response including zeros at a higher frequency than a pass band is implemented, as will be described in more detail below with respect to the receive band in FIG. 9B. In contrast, if the tips of the couplings 431, 432 are close and the grounded ends distant, as shown in FIG.

4E, the coupling will be predominantly electric, which will be negative, thereby allowing a filter with zeros at a lower frequency to a pass band to be implemented, similar to that shown at 350, 351, 352, 353 in FIG. 3B.

Figure 4F:
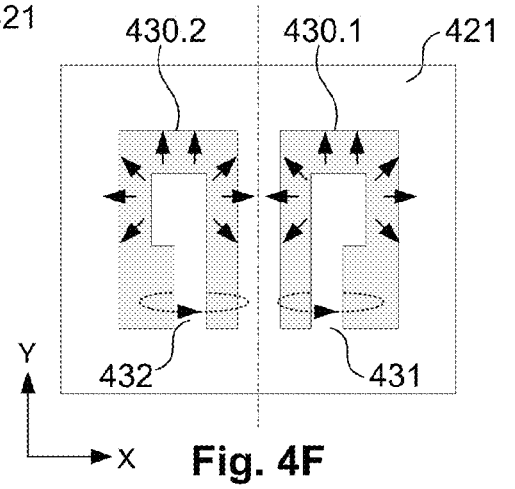

In the example of FIG. 4F, two coupling structures 430.1, 430.2 are provided on a ground plane 421, each coupling structure defining 430.1, 430.2 a respective coupling 431, 432. The couplings are similar to those described above and will not therefore be described in further detail. The provision of multiple coupling structures allows a large variety of arrangements to be provided. For example, the coupling structures can be provided on different surfaces, of the resonator body, as shown by the dotted line. This could be performed by using a shaped substrate, or by providing separate substrates for each coupling structure. This also allows for multiple inputs and/or outputs to be provided.

Figure 5:
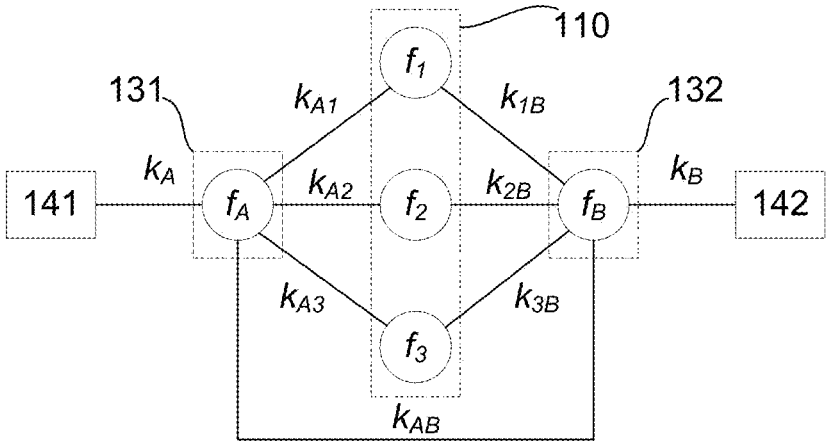
FIG. 5 is a schematic diagram of an example of a filter network model for the filter of FIGS. 1A to 1E.

In practice, the filter described in FIGS. 1A to 1E can be modelled as two low Q resonators, representing the input and output couplings 131, 132 coupled to three high Q resonators, representing the resonance modes of the resonator body 110, and with the two low Q resonators also being coupled to each other. An example filter network model is shown in FIG. 5.

In this example, the input and output couplings 131, 132 have respective resonant frequencies $f_A$, $f_B$, whilst the resonance modes of the resonator body 110 have respective resonant frequencies $f_1$, $f_2$, $f_3$. The degree of coupling between an input 141 and output 142 and the respective input and output couplings 131, 132 is represented by the coupling constants $k_A$, $k_B$. The coupling between the couplings 131, 132 and the resonance modes of the resonator body 110 are represented by the coupling constants $k_{A1}$, $k_{A2}$, $k_{A3}$, and $k_{1B}$, $k_{2B}$, $k_{3B}$, respectively, whilst coupling between the input and output couplings 131, 132 is given by the coupling constant $k_{AB}$.

It will therefore be appreciated that the filtering response of the filter can be controlled by controlling the coupling constants and resonance frequencies of the couplings 131, 132 and the resonator body 110.

In one example, a desired frequency response is obtained by configuring the resonator body 110 so that $f_1<f_2<f_3$ and the couplings 131, 132 so that $f_1<f_A$, $f_B<f_3$. This places the first resonator $f_1$ close to the desired sharp transition at the band edge, as shown for example at 353, 363 in FIG. 3B. The coupling constants $k_{A1}$, $k_{A3}$, $k_{1B}$, $k_{2B}$, $k_{3B}$, are selected to be positive, whilst the constant $k_{A2}$ is negative. If the zeros are to be on the low frequency side of the pass band, as shown for example at 351, 352, 353 and as will be described in more detail below with respect to the transmit band in FIG. 9B, the coupling constant $k_{AB}$ should be negative, while if the zeros are to be on the high frequency side as will be described in more detail below with respect to the receive band in FIG. 9B, the coupling constant $k_{AB}$ should be positive. The coupling constants $k_{AB}$, $k_{A1}$ generally have similar magnitudes, although this is not essential, for example if a different frequency response is desired.

Figure 6A:
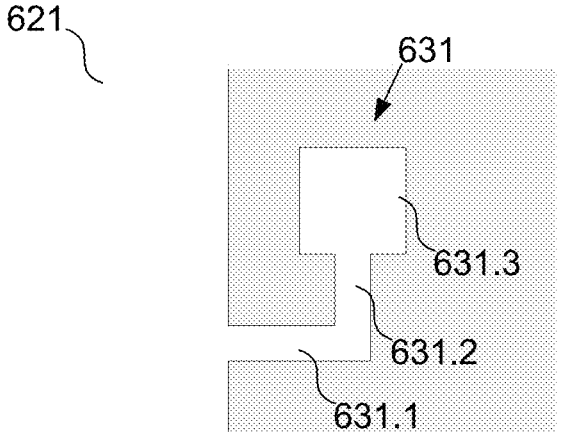
FIGS. 6A to 6C are schematic plan views of example couplings illustrating how coupling configuration impacts on coupling constants of the filter.
Figure 6B:
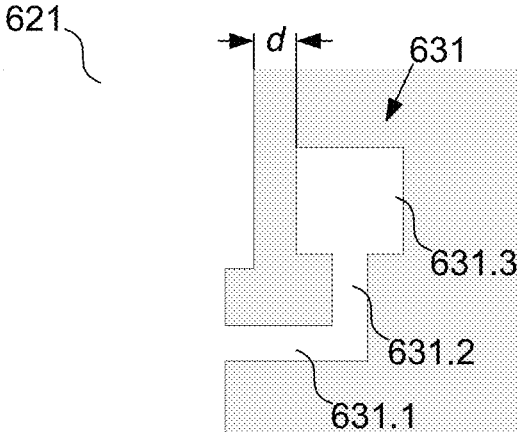
Figure 6C:
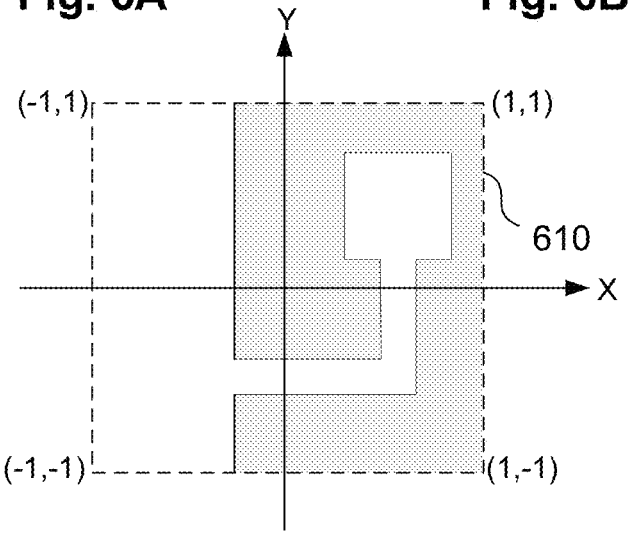

The strength of the coupling constants can be adjusted by varying the shape and position of the input and output couplings 131, 132, as will now be described in more detail with reference to FIGS. 6A to 6C.

For the purpose of this example, a single coupling 631 is shown coupled to a ground plane 621. The coupling 631 is of a similar form to the coupling 131 and therefore includes a first path 631.1 extending perpendicularly away from the ground plane 621, a second path 631.2 extending in a direction orthogonal to the first path 631.1 and terminating in a conductive coupling patch 631.3. In use, the first and second paths 631.1, 631.2 are typically arranged parallel to the axes of the resonator body, as shown by the axes X, Y, with the coordinates of FIG. 6C representing the locations of the coupling paths relative to a resonator body shown by the dotted lines 610, extending from (−1,−1) to (1,1). This is for the purpose of example only, and is not intended to correspond to the positioning of the resonator body in the examples outlined above. To highlight the impact of the configuration of the coupling 631 on the degrees of coupling reference is also made to the distance d shown in FIG. 6B, which represents the proximity of patch 631.3 to the ground plane 621.

In this example, the first path 631.1 is provided adjacent to the grounded end of the coupling 631 and therefore predominantly generates a magnetic field as it is near a current anti-node. The second path 631.2 has a lower current and some voltage and so will generate both magnetic and electric fields. Finally the patch 631.3 is provided at an open end of the coupling and therefore predominantly generates an electric field since it is near the voltage anti-node.

In use, coupling between the coupling 631 and the resonator body can be controlled by varying coupling parameters, such as the lengths and widths of the coupling paths 631.1, 631.2, the area of the coupling patch 631.3, as well as the distance d between the coupling patch 631.3 and the ground plane 621. In this regard, as the distance d decreases, the electric field is concentrated near the perimeter of the resonator body, rather than up into the bulk of the resonator body, so this decreases the electric coupling to the resonance modes.

Referring to the field directions of the three cavity modes shown in FIGS. 2A to 2C, the effect of varying the coupling parameters is as summarised in Table 4 below. It will also be appreciated however that varying the coupling path width and length will affect the impedance of the path and hence the frequency response of the coupling path 631. Accordingly, these effects are general trends which act as a guide during the design process, and in practice multiple changes in coupling frequencies and the degree of coupling occur for each change in coupling structure and resonator body geometry. Consequently, when designing a coupling structure geometry it is typical to perform simulations of the 3D structure to optimise the design.

TABLE 4

| Mode | Coupling Strength to Quarter Wave Resonator |
|---|---|
| TE 011 (E along X) | Maximum coupling when the first path 631.1 is long and at y = 0.<br>Negligible coupling from the second path 631.2.<br>Negligible coupling from the patch 631.3 when positioned at x = 0, y = 0. |
| TE 101 (E along Y) | Negligible coupling from the first path 631.1.<br>Maximum coupling when the second path 631.2 is long and at x = 0.<br>Negligible coupling from the patch 631.3 when positioned at x = 0, y = 0. |
| TM 110 (E along Z) | Maximum coupling when the first path 631.1 is long and at x = −1, y = 0.<br>Maximum coupling when the second path 631.2 is long and at x = 0, y = +1 or −1.<br>Maximum coupling when the patch 631.3 is large and at x = 0, y = 0.<br>Decreased coupling when the distance d is small. |

Figure 7A:
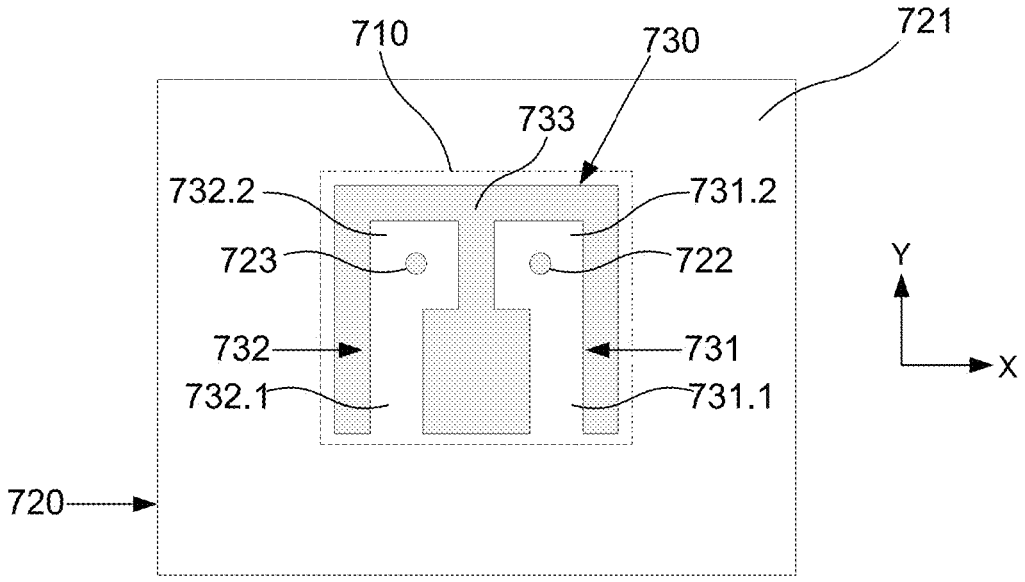
FIGS. 7A to 7C are schematic plan views of examples of alternative coupling structures for the filter of FIGS. 1A to 1E.
Figure 7B:
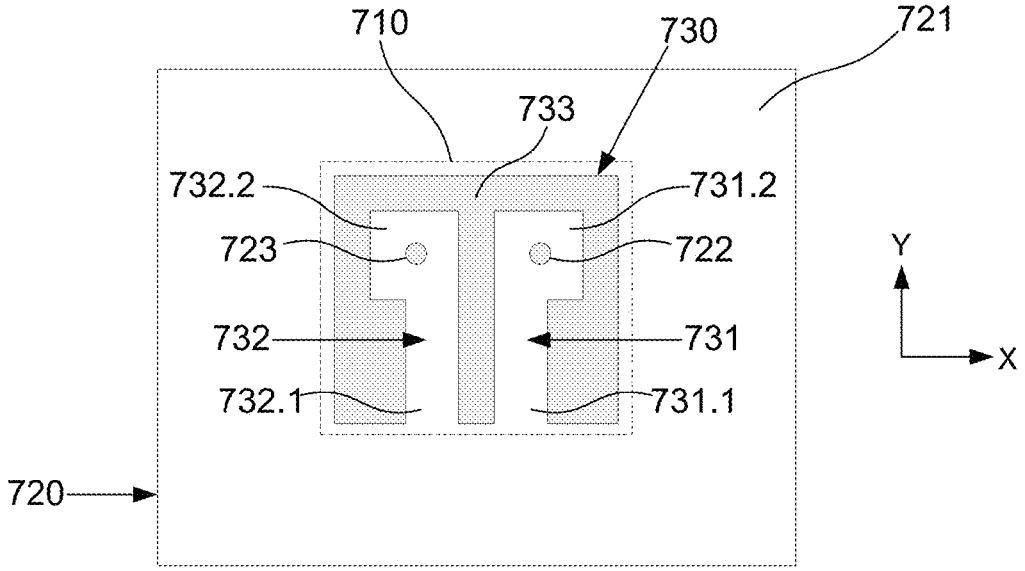
Figure 7C:
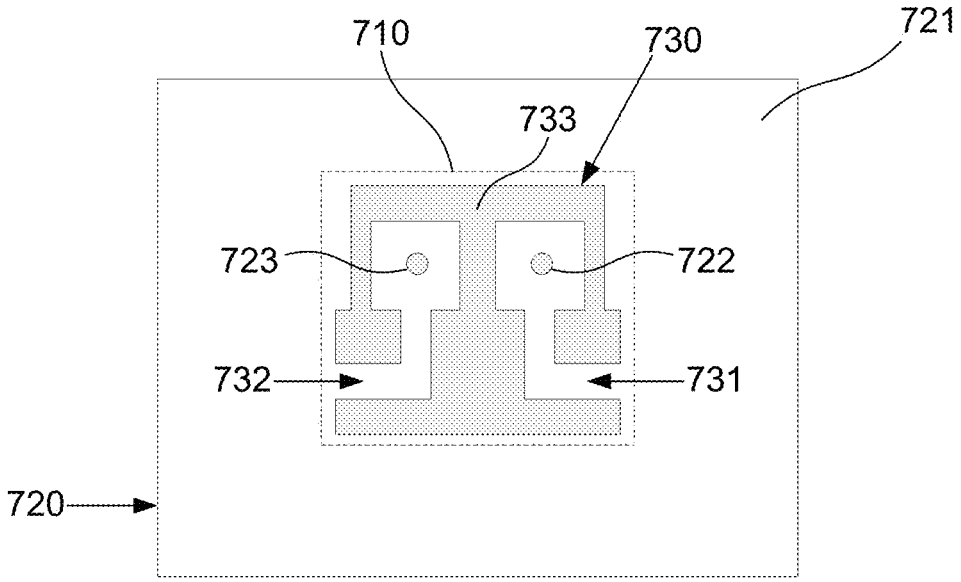

It will be appreciated from the above that a range of different coupling structure configurations can be used, and examples of these are shown in FIGS. 7A to 7C. In these examples, reference numerals similar to those used in FIG. 1D are used to denote similar features, albeit increased by 600.

Thus, in each example, the arrangement includes a resonator body 710 mounted on a substrate 720, having a ground plane 721. A coupling structure 730 is provided by a cut-out 733 in the ground plane 721, with the coupling structure including two couplings 731, 732, representing input and output couplings respectively. In this example, vias 722, 723 act as connections to an input and output respectively (not shown in these examples).

In the examples of FIGS. 7A and 7B, the input and output couplings 731, 732 include a single coupling path 731.1, 732.1 extending from the ground plane 721 to a patch 731.2, 732.2, in a direction parallel to an X-axis. The paths 731.1, 732.1 generate a magnetic field that couples to the TE101 and TM modes, whilst the patch predominantly couples to the TM mode.

In the example of FIG. 7B the grounded ends of the couplings 731.1, 732.1 are close whilst the coupling tips are distant. Consequently, the coupling will be mainly magnetic and so the coupling will be positive, thereby allowing a filter having high frequency zeros to be implemented. In contrast, if the tips of the couplings 731.1, 732.1 are close and the grounded ends distant, as shown in FIG. 7A, the coupling will be predominantly electric, which will be negative and thereby allow a filter with low frequency zeros to be implemented.

In the arrangement of FIG. 7C, this shows a modified version of the coupling structure of FIG. 1D, in which the cut-out 733 is modified so that the patch 731.3, 732.3 is nearer the ground plane, thereby decreasing coupling to the TM field, as discussed above.

In some scenarios, a single resonator body cannot provide adequate performance (for example, attenuation of out of band signals). In this instance, filter performance can be improved by providing two or more resonator bodies arranged in series, to thereby implement a higher-performance filter.

In one example, this can be achieved by providing two resonator bodies in contact with each other, with one or more apertures provided in the silver coatings of the resonator bodies, where the bodies are in contact. This allows the fields in each cube to enter the adjacent cube, so that a resonator body can receive a signal from or provide a signal to another resonator body. When two resonator bodies are connected, this allows each resonator body to include only a single coupling, with a coupling on one resonator body acting as an input and the coupling on the other resonator body acting as an output. Alternatively, the input of a downstream filter can be coupled to the output of an upstream filter using a suitable connection such as a short transmission line. An example of such an arrangement will now be described with reference to FIGS. 8A to 8E.

In this example, the filter includes first and second resonator bodies 810A, 810B mounted on a common substrate 820. The substrate 820 is a multi-layer substrate providing external surfaces 821, 825 defining a common ground plane, and an internal surface 824.

In this example, each resonator body 810A, 810B is associated with a respective coupling structure 830A, 830B provided by a corresponding cut-out 833A, 833B in the ground plane 821. The coupling structures 830A, 830B include respective input and output couplings 831A, 832A, 831B, 832B, which are similar in form to those described above with respect to FIG. 1D, and will not therefore be described in any detail. Connections 822A, 823A, 822B, 823B couple the couplings 831A, 832A, 831B, 832B to paths on the internal layer 824. In this regard, an input 841 is coupled via the connection 822A to the coupling 831A. A connecting path 843 interconnects the couplings 832A, 831B, via connections 823A, 822B, with the coupling 823B being coupled to an output 842, via connection 823B.

It will therefore be appreciated that in this example, signals supplied via the input 841 are filtered by the first and second resonator bodies 810A, 810B, before in turn being supplied to the output 842.

Figure 8A:
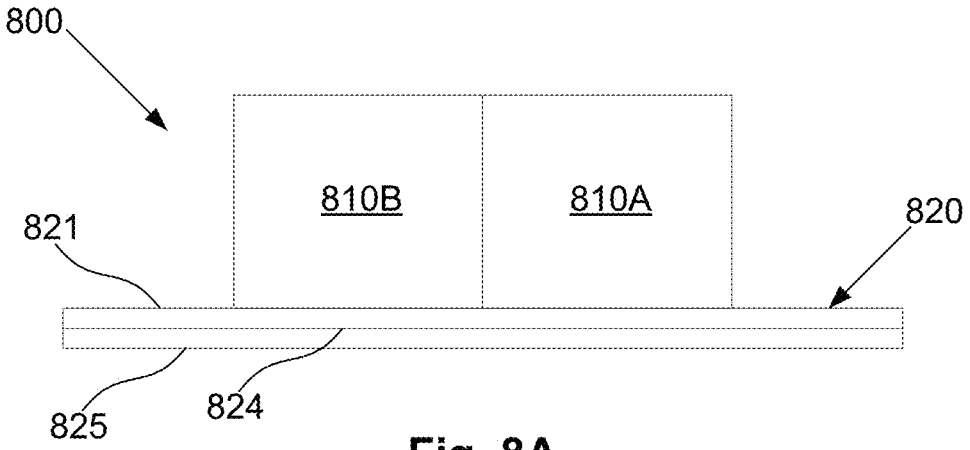
FIG. 8A is a schematic side view of an example of a multi-mode filter using multiple resonator bodies.
Figure 8B:
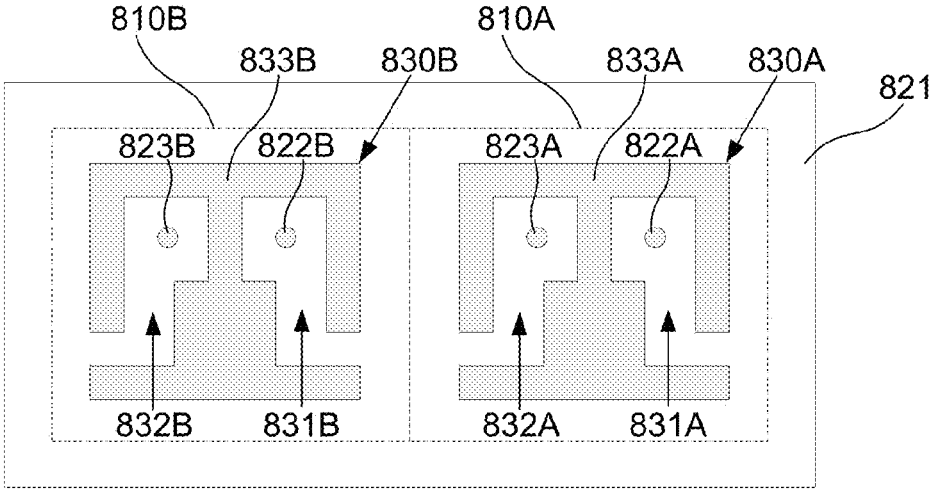
FIG. 8B is a schematic plan view of an example of the substrate of FIG. 8A including multiple coupling structures.
Figure 8C:
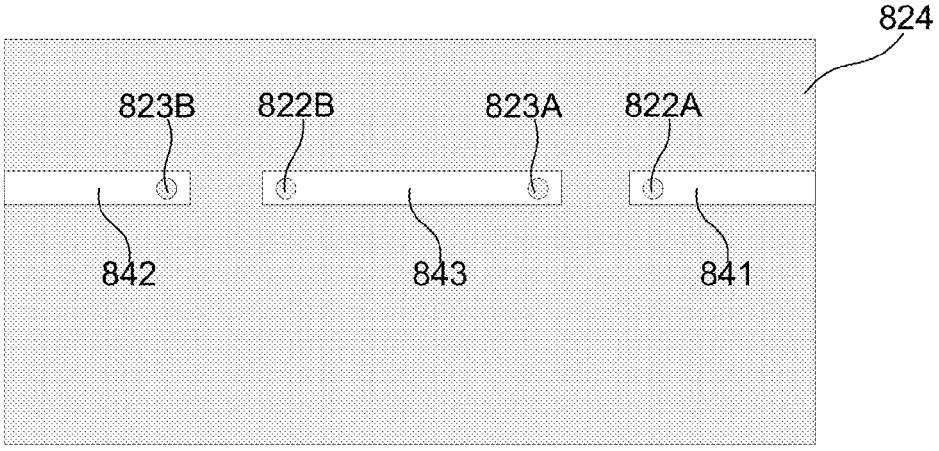
FIG. 8C is a schematic internal view of an example of the substrate of FIG. 8A including inputs and outputs.
Figure 8D:
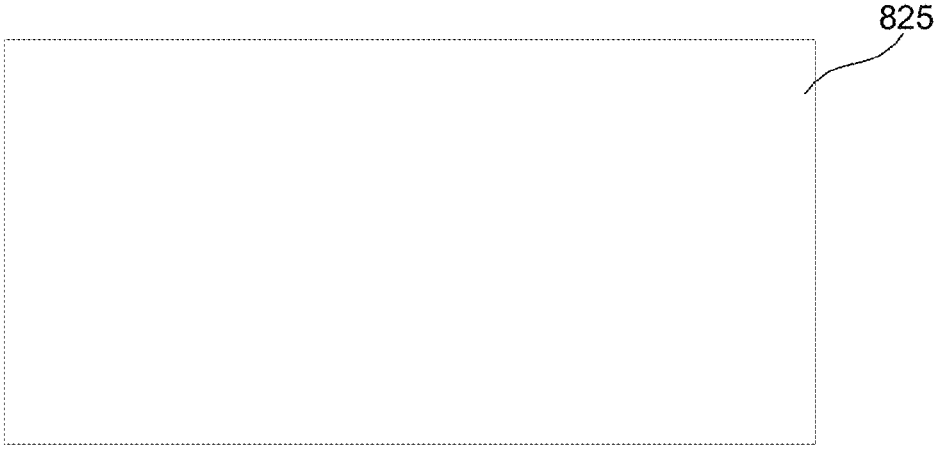
FIG. 8D is a schematic underside view of an example of the substrate of FIG. 8A.
Figure 8E:
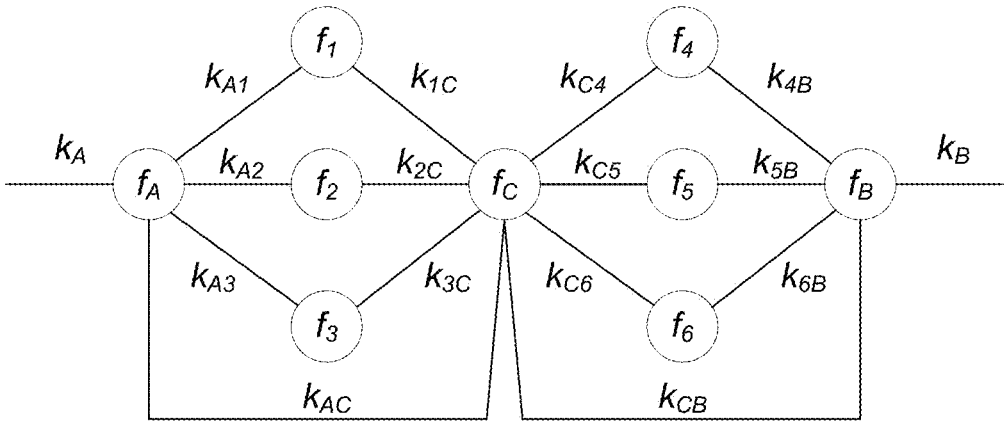
FIG. 8E is a schematic diagram of an example of a filter network model for the filter of FIGS. 8A to 8D.

In this arrangement, the connecting path 843 acts like a resonator, which distorts the response of the filters so that the cascade response cannot be predicted by simply multiplying the responses of the two cascaded filters. Instead, the resonance in the transmission line must be explicitly included in a model of the whole two cube filter. For example, the transmission line could be modelled as a single low Q resonator having frequency $f_C$, as shown in FIG. 8E.

Figure 9A:
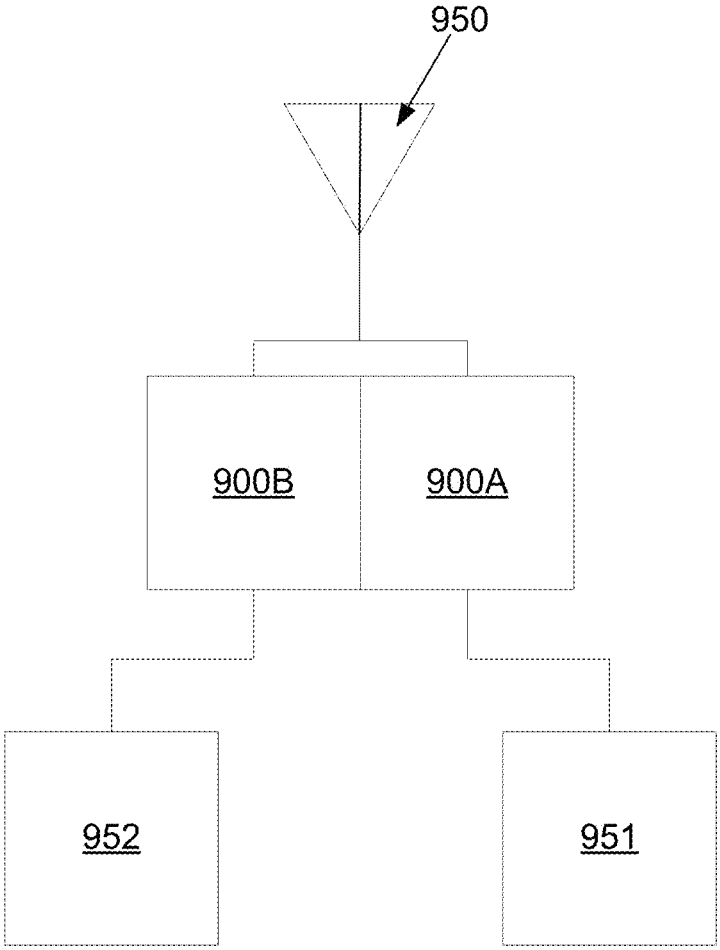
FIG. 9A is a schematic diagram of an example of a duplex communications system incorporating a multi-mode filter.

A common application for filtering devices is to connect a transmitter and a receiver to a common antenna, and an example of this will now be described with reference to FIG. 9A. In this example, a transmitter 951 is coupled via a filter 900A to the antenna 950, which is further connected via a second filter 900B to a receiver 952.

In use, the arrangement allows transmit power to pass from the transmitter 951 to the antenna with minimal loss and to prevent the power from passing to the receiver. Additionally, the received signal passes from the antenna to the receiver with minimal loss.

Figure 9B:
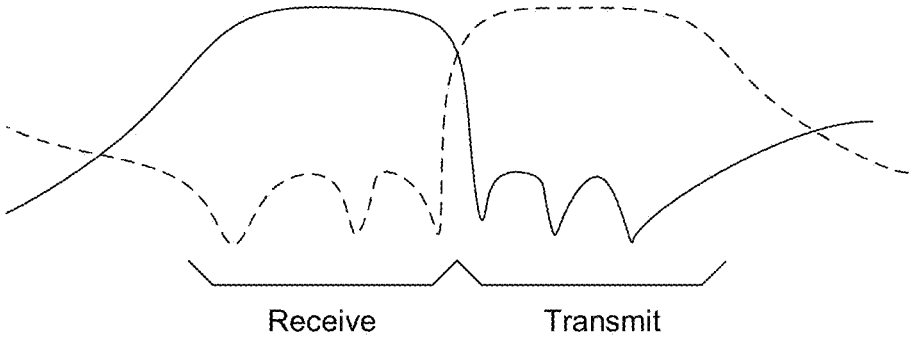
FIG. 9B is a schematic diagram of an example of the frequency response of the multi-mode filter of FIG. 9A.

An example of the frequency response of the filter is as shown in FIG. 9B. In this example, the receive band (solid line) is at lower frequencies, with zeros adjacent the receive band on the high frequency side, whilst the transmit band (dotted line) is on the high frequency side, with zeros on the lower frequency side, to provide a high attenuation region coincident with the receive band. It will be appreciated from this that minimal signal will be passed between bands. It will be appreciated that other arrangements could be used, such as to have a receive pass band at a higher frequency than the transmit pass band.

Figure 9C:
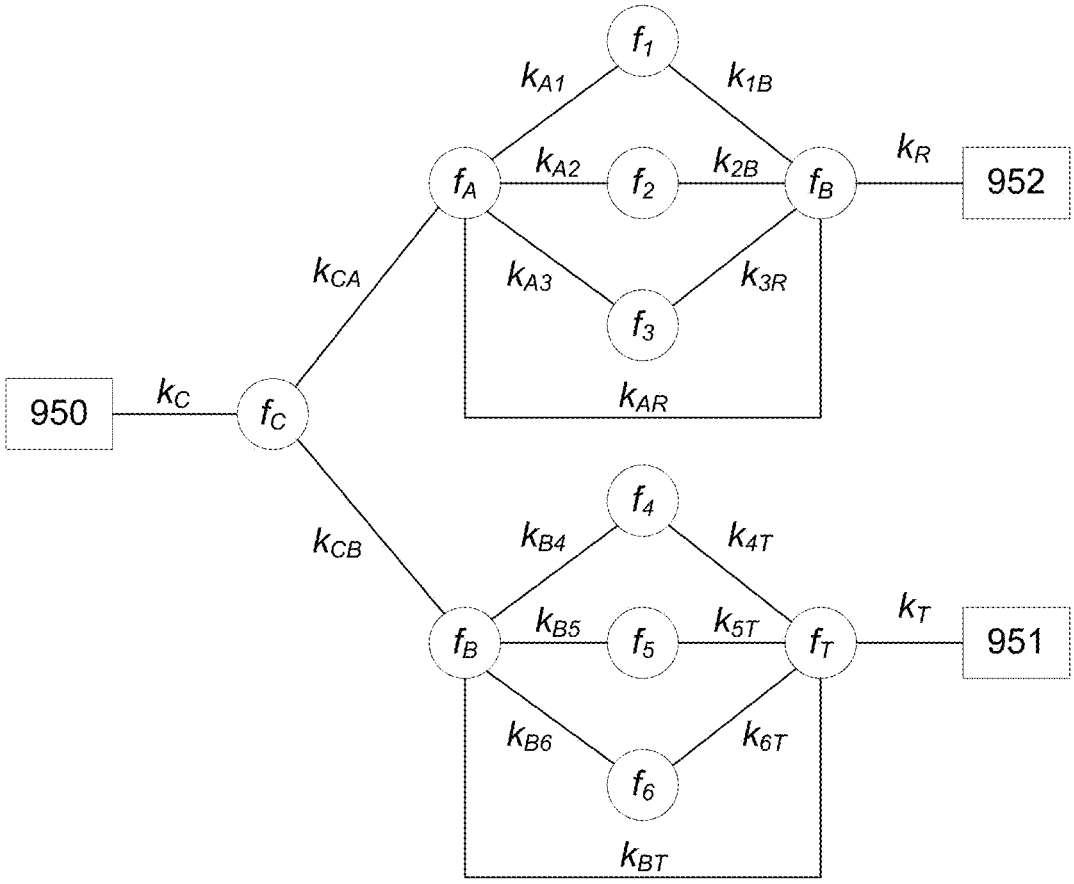
FIG. 9C is a schematic diagram of an example of a filter network model for the filter of FIG. 9A.

The duplexed filter can be modelled in a similar way to the single cube and cascaded filters, with an example model for a duplexer using single resonator body transmit and receive filters being shown in FIG. 9C. In this example, the transmit and receive filters 900A, 900B are coupled to the antenna via respective transmission lines, which in turn provide additional coupling represented by a further resonator having a frequency $f_C$, and coupling constants $k_C$, $k_{CA}$, $k_{CB}$, determined by the properties of the transmission lines.

Figure 10B:
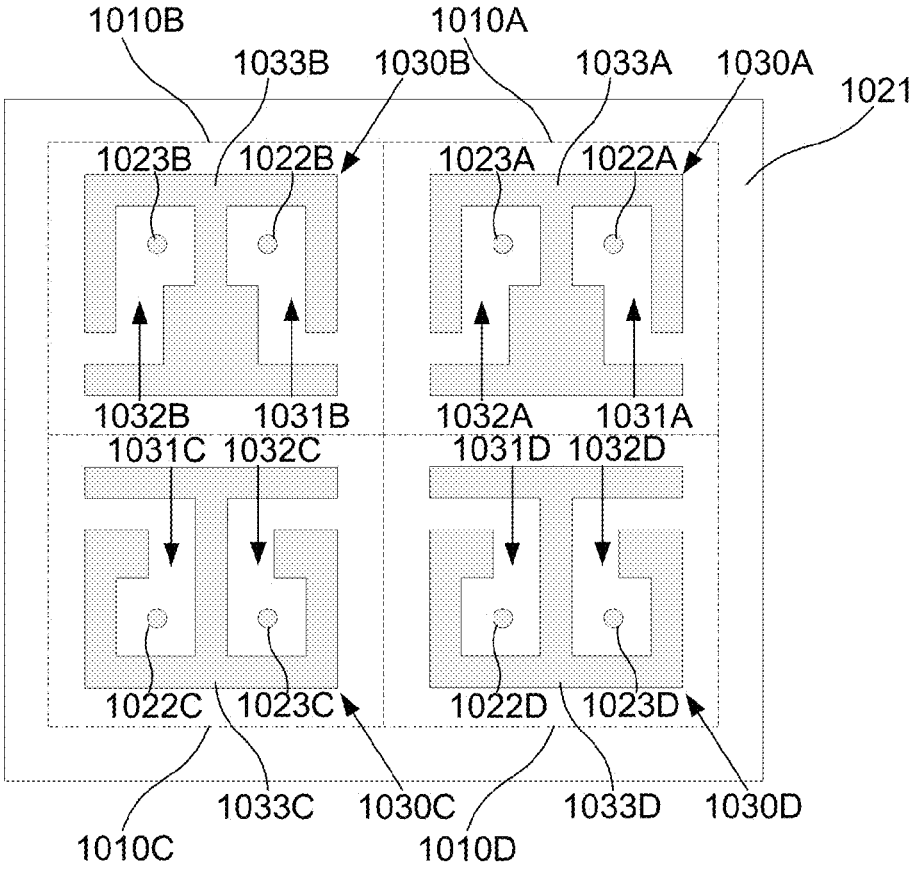
FIG. 10B is a schematic plan view of an example of the substrate of FIG. 10A including multiple coupling structures.
Figure 10C:
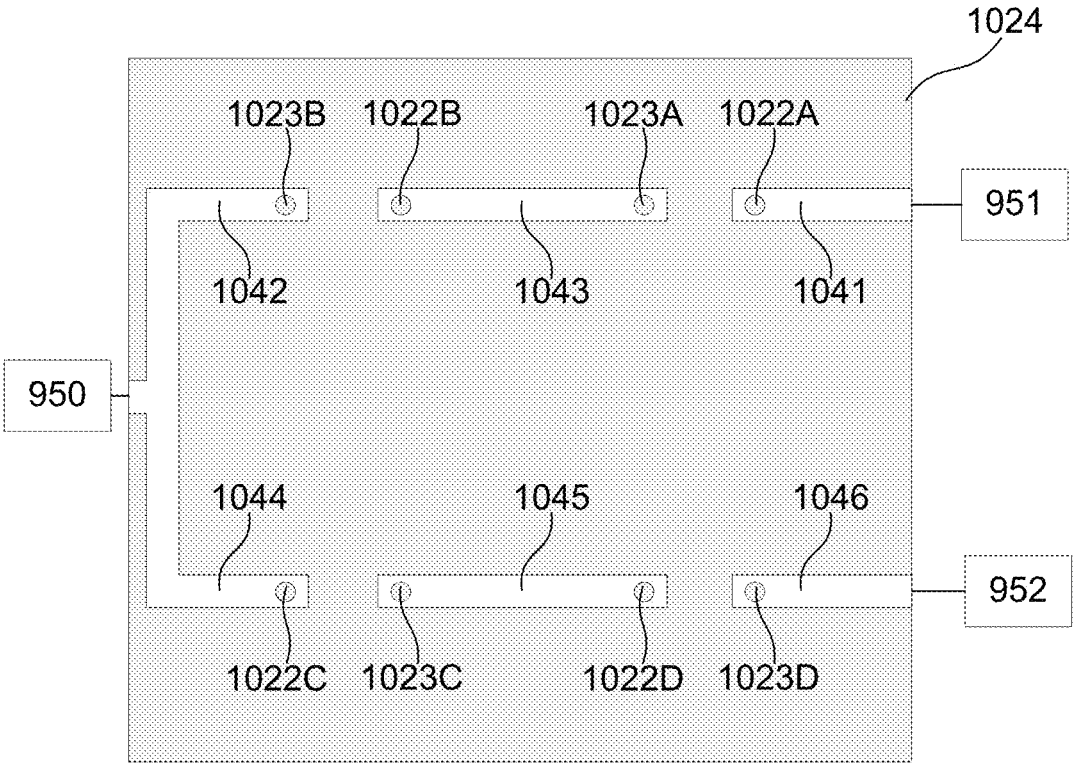
FIG. 10C is a schematic underside view of an example of the substrate of FIG. 10A including inputs and outputs.

It will be appreciated that the filters 900A, 900B can be implemented in any suitable manner. In one example, each filter 900 includes two resonator bodies provided in series, with the four resonator bodies mounted on a common substrate, as will now be described with reference to FIGS. 10A to 10C.

In this example, multiple resonator bodies 1010A, 1010B, 1010C, 1010D can be provided on a common multi-layer substrate 1020, thereby providing transmit filter 900A formed from the resonator bodies 1010A, 1010B and a receive filter 900B formed from the resonator bodies 1010C, 1010D.

As in previous examples, each resonator body 1010A, 1010B, 1010C, 1010D is associated with a respective coupling structure 1030A, 1030B, 1030C, 1030D provided by a corresponding cut-out 1033A, 1033B, 1033C, 1033D in a ground plane 1021. Each coupling structure 1030A, 1030B, 1030C, 1030D includes respective input and output couplings 1031A, 1032A, 1031B, 1032B, 1031C, 1032C, 1031D, 1032D, which are similar in form to those described above with respect to FIG. 1D, and will not therefore be described in any detail. However, it will be noted that the coupling structures 1030A, 1030B, for the transmitter 951 are different to the coupling structures 1030C, 1030D for the receiver 952, thereby ensuring that different filtering characteristic are provided for the transmit and receive channels, as described for example with respect to FIG. 9B.

Connections 1022A, 1023A, 1022B, 1023B, 1022C, 1023C, 1022D, 1023D couple the couplings 1031A, 1032A, 1031B, 1032B, 1031C, 1032C, 1031D, 1032D, to paths on an internal layer 1024 of the substrate 1020. In this regard, an input 1041 is coupled via the connection 1022A to the coupling 1031A. A connecting path 1043 couples the couplings 1032A, 1031B, via connections 1023A, 1022B, with the coupling 1023B being coupled to an output 1042, and hence the antenna 950, via a connection 1023B. Similarly an input 1044 from the antenna 950 is coupled via the connection 1022C to the input coupling 1031C. A connecting path 1045 couples the couplings 1032C, 1031D, via connections 1023C, 1022D, with the coupling 1022D being coupled to an output 1046, and hence the receiver 952, via a connection 1023D.

Accordingly, the above described arrangement provides a cascaded duplex filter arrangement. The lengths of the transmission lines can be chosen such that the input of each appears like an open circuit at the centre frequency of the other. To achieve this, the filters are arranged to appear like 50 ohm loads in their pass bands and open or short circuits outside their pass bands.

It will be appreciated however that alternative arrangements can be employed, such as connecting the antenna to a common coupling, and then coupling this to both the receive and transmit filters. This common coupling performs a similar function to the transmission line junction above.

Accordingly, the above described filter arrangements use a multimode filter described by a parallel connection, at least within one body. The natural oscillation modes in an isolated body are identical with the global eigenmodes of that body. When the body is incorporated into a filter, a parallel description of the filter is the most useful one, rather than trying to describe it as a cascade of separate resonators.

The filters can not only be described as a parallel connection, but also designed and implemented as parallel filters from the outset. The coupling structures on the substrate are arranged so as to controllably couple with prescribed strengths to all of the modes in the resonator body, with there being sufficient degrees of freedom in the shapes and arrangement of the coupling structures and in the exact size and shape of the resonator body to provide the coupling strengths to the modes needed to implement the filter design. There is no need to introduce defects into the body shape to couple from mode to mode. All of the coupling is done via the coupling structures, which are typically mounted on a substrate such as a PCB. This allows us to use a very simple body shape without cuts of bevels or probe holes or any other complicated and expensive departures from easily manufactured shapes.

It will of course be appreciated that not all implementations of a filter require two or more resonator bodies to be coupled together. It is possible to design a filter having large range of filter responses using a single resonator body. By selecting the frequency at which each transmission zero occurs, it is possible to influence the shape of the frequency response and, hence, for example, the shape of the edges of the pass-band of the filter.

It is possible to control the frequency at which the transmission zeros occur by positioning the input and output coupling paths 131, 132 in particular orientations and locations relative to one another, and relative to the edges of the resonator body 110. The position of the, or each, transmission zero (i.e the frequency at which each zero occurs) is important in defining the notches in a frequency response of a filter.

A key to achieving zeros at desired frequencies, such that the pass-band is well defined with steep edges, is arranging the input coupling 131 and the output coupling 132 in such a way that enables control of the relative phases of the couplings. The mechanism, called anti-phase cancellation, will be known to those skilled in the art. In this description, the resonance modes of a resonator body 110 will be denoted X-mode, Y-mode and Z-mode, such that the X-mode is an excitation mode in the direction of the X axis, the Y-mode is an excitation mode in the direction of the Y axis and the Z-mode is an excitation mode in the direction of the Z-axis.

In one example, a three dimensional resonator body has three resonance modes (X, Y, Z), and has an input coupling 131 and an output coupling 132 formed on one face thereof. A signal fed into the input is able to travel between the input and the output along four different paths; via the X-mode; via the Y-mode; via the Z-mode; and directly between the input coupling and the output coupling. From four paths, three zeros can be generated. More generally, N paths will generate N−1 independently-controllable zeros. The signals travelling along each of the paths are phase-shifted with respect to one another. Thus, where a signal travelling along one path is out of phase relative to a signal travelling along another path, there will be some degree of cancellation. At some frequency, the paths will be 180° out of phase and, at that frequency, if the amplitudes of signals travelling along those paths were equal, then there would be total cancellation of the signal. A zero would occur at that frequency. Those skilled in the art will appreciate that the actual frequencies at which zeros occur are determined from a consideration of the combination of at least partial anti-phase cancellation resulting from all four paths.

Whether the zeros occur below, above or within the pass-band depends on the phase and amplitude of each coupling and the widths of the resonance peaks (which, in turn, vary the rate of change of the phase). Inverting the phase of, for example, the direct input-output coupling path, can cause a zero to be generated on the opposite side of the resonance peak for a given mode, or can do so for the whole pass-band, depending on the phase difference involved.

Figure 11:
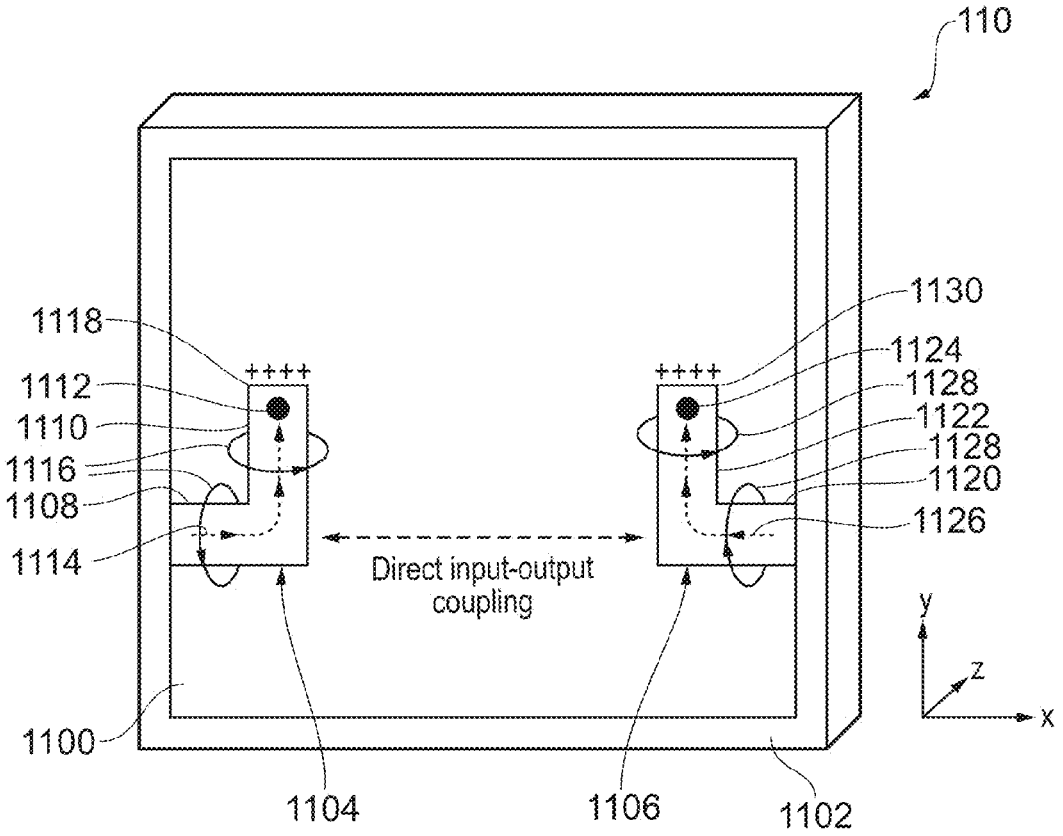
FIG. 11 is a schematic view of a first arrangement of couplings on a multi-mode filter.

FIG. 11 is an underside view of the resonator body 110, showing an underside face 1100 of the body. The underside face 1100 lies in the X-Y plane. A metal coating 1102 is formed on five of the faces of the resonator body 110, and around the periphery of the underside face 1100, forming a metallised frame 1102 around the underside face. An input coupling track 1104 and an output coupling track 1106 are formed on the face 1100, and each coupling track may be electrically connected at one end thereof to the metallised frame 1102 around the edge of the face. It will be clear to those skilled in the art that the input coupling track 1104 is used to couple a signal into the resonator body 110, and the output coupling track 1106 is used to couple the signal out of, or retrieve the signal from, the resonator body.

By locating the input coupling track 1104 and the output coupling track 1106 on the same face 1100, a degree of coupling between the input and output coupling tracks can occur. By controlling the coupling between the input coupling track 1104 and the output coupling track 1106, and by controlling the coupling of the input track and the output track with the various resonance modes of the resonator body, it is possible to control the locations at which zeros occur. More specifically, the frequencies at which all three zeros occur can be controlled by controlling the relative 'phases' of the couplings made by the input coupling track 1104 and the output coupling track 1106. The term 'phases' is intended to mean the relative directions of current flowing through the couplings which result in, or from, the X-mode, Y-mode and Z-mode excitations.

In the embodiment shown in FIG. 11, the input coupling track 1104 is generally L-shaped, with a first section 1108 extending from the metallised frame 1102, and a second section 1110 extending in a direction perpendicular to the first section. A signal input feed-point 1112 is located towards an end of the second section 1110 of the input coupling track 1104 for feeding a signal into the resonator body 110.

An arrow 1114 shows the direction in which current flows through the input coupling track 1104. In this example, current flows between the metallised frame 1102, along the first section 1108 of the input coupling track 1104 in the X-direction (from left to right in FIG. 11), then along the second section 1110 of the input coupling track in the Y-direction (from bottom to top in FIG. 11). Arrows 1116 denote a magnetic field generated by the current flowing through the input coupling track 1104. The direction of the magnetic field will be apparent from basic field theory.

The magnetic field generated by current flowing through the first section 1108 of the input coupling track 1104 excites the X-mode of the resonator body 110, and the magnetic field generated by current flowing through the second section 1110 of the input coupling track excites the Y-mode of the resonator body. The electric field generated by an excitation voltage at the input coupling track 1104 is a maximum at an end 1118 furthest along the track from the metallised frame 1102. In this example, the maximum electric field occurs at the end 1118 of the second section 1110 of the input coupling track 1104, and the electric field couples primarily in the Z-direction, thereby exciting the Z-mode of the resonator body 110.

The output coupling track 1106 is similar in shape to the input coupling track 1104 (that is, generally L-shaped), and has a first section 1120 extending from the metallised frame 1102, and a second section 1122 extending in a direction perpendicular to the first section. A signal output feed-point 1124 is located towards an end of the second section 1122 of the output coupling track 1106 for retrieving a signal from the resonator body 110.

The instantaneous direction of current flow in the output coupling track 1106 differs from the direction of current flow in the input coupling track 1104. Current flows (in the direction of arrow 1126) through the output coupling track 1106 from the metallised frame 1102, along the first section 1120 in the X-direction (from right to left in FIG. 11; opposite to the direction of current flow in the first section of the input coupling track 1104), then along the second section 1122 of the output coupling track in the Y-direction (from bottom to top in FIG. 11; the same direction as the current flow in the second section of the input coupling track). Arrows 1128 denote a magnetic field that exists around the output coupling track 1106, and a maximum of the electric field occurring at an end 1130 of the output coupling track, denoted by '++++'. It will be apparent that the direction of the magnetic field around the second section 1124 (Y-direction) of the output coupling track 1106 is the same as the direction of the magnetic field around the second section 1110 (Y-direction) of the input coupling track 1104. However, the direction of the magnetic field around the first section 1120 (X-direction) of the output coupling track 1106 is the opposite to the direction of the magnetic field around the first section 1108 (X-direction) of the input coupling track 1104. In other words, the coupling from the X-mode by the output coupling track 1106 can be considered to be 180 degrees out of phase with the coupling to the X-mode by the input coupling track 1104.

It will be appreciated by those skilled in the art that the modes excited by the magnetic fields around the various sections of the output coupling track 1106 correspond to those modes excited by current flowing through the corresponding sections of the input coupling track 1104. It will also be appreciated that, since the currents involved in this embodiment are alternating currents (AC), the arrows showing the direction of current flow represent the direction of current in one half of a cycle. The arrows could be reversed to represent the direction of current flowing in the opposite half-cycle. In this regard, it will be apparent that the absolute direction of current flow is irrelevant in determining the positioning of the zeros. Rather, the relative direction, or phase, of the current flow is the determining factor.

It will also be appreciated by those skilled in the art that coupling structures with sections which do not run parallel or perpendicular to the faces of the resonator body are still capable of exciting the main degenerate resonant modes in that body, since a vector component of the electric (E) field or magnetic (H) field, or both fields, will extend in the required parallel or perpendicular directions. Thus, for example, a track extending at an angle of 45 degrees from an edge of the metallised frame on one face of the resonator body will excite both the X and Y modes. The excitation will be approximately equal for both modes, since the vector component of the field generated by the track will be equal when resolved in the X and the Y directions. Likewise, tracks extending at other angles will excite both the X and Y modes to differing degrees, depending upon the angle subtended by the track in the X and Y directions, and consequently the magnitude of the E and H-field vectors when resolved in the X and Y directions. For example, an acute angle to the X-direction, say, will generate a larger coupling to the X-mode and a smaller coupling to the Y-mode.

Figure 12:
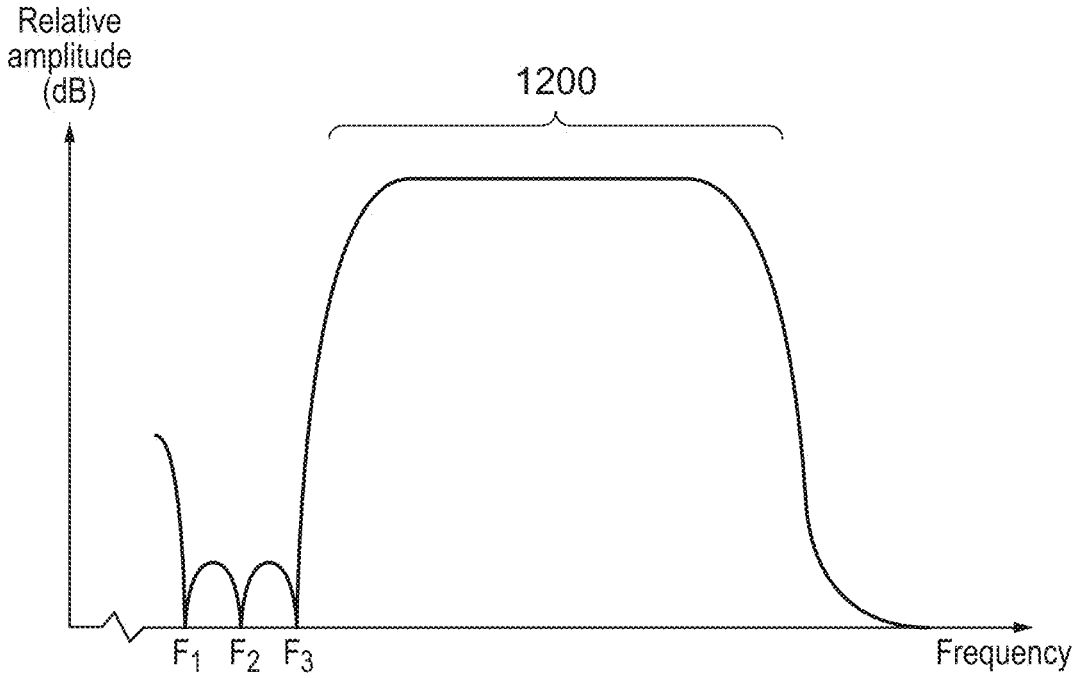
FIG. 12 is a plot of a filter response resulting from the arrangement shown in FIG. 11.

FIG. 12 shows a filter response of a filter incorporating the arrangement of couplings shown in FIG. 11. The filter response shows how the amplitude of a signal varies with frequency as a result of being fed through the filter. The arrangement shown in FIG. 11 results in a filter response having a pass-band 1200 with three zeros at frequencies $F_1$, $F_2$ and $F_3$, located below the pass-band. A consequence of three zeros being located to one side of the pass-band 1200 is that the out-of-band rejection is improved. That is to say, the amplitude of any signal falling within the range of frequencies from $F_1$ to $F_3$ is relatively very small.

The relative phases of the coupling to each of the modes by the input and output coupling tracks (1104, 1106) are shown in Table 5, where '+' denotes a first phase, and '−' denotes a second, opposite phase.

TABLE 5

| Mode | Input coupling track phase | Output coupling track phase | Location of mode resonant frequency relative to the desired pass-band centre frequency | Phase of direct input-output coupling |
|---|---|---|---|---|
| X | + | − | Centre | − |
| Y | + | + | Bottom | |
| Z | + | + | Top | |

Thus, the central part of the pass-band 1200 results from a pole (an amplitude maximum) caused by the excitation of the X-mode, the lower frequency part (on the left-hand side) of the pass-band results from a pole caused by the excitation of the Y-mode, and the higher frequency part (on the right-hand side) of the pass-band results from a pole caused by the excitation of the Z-mode.

Figure 13:
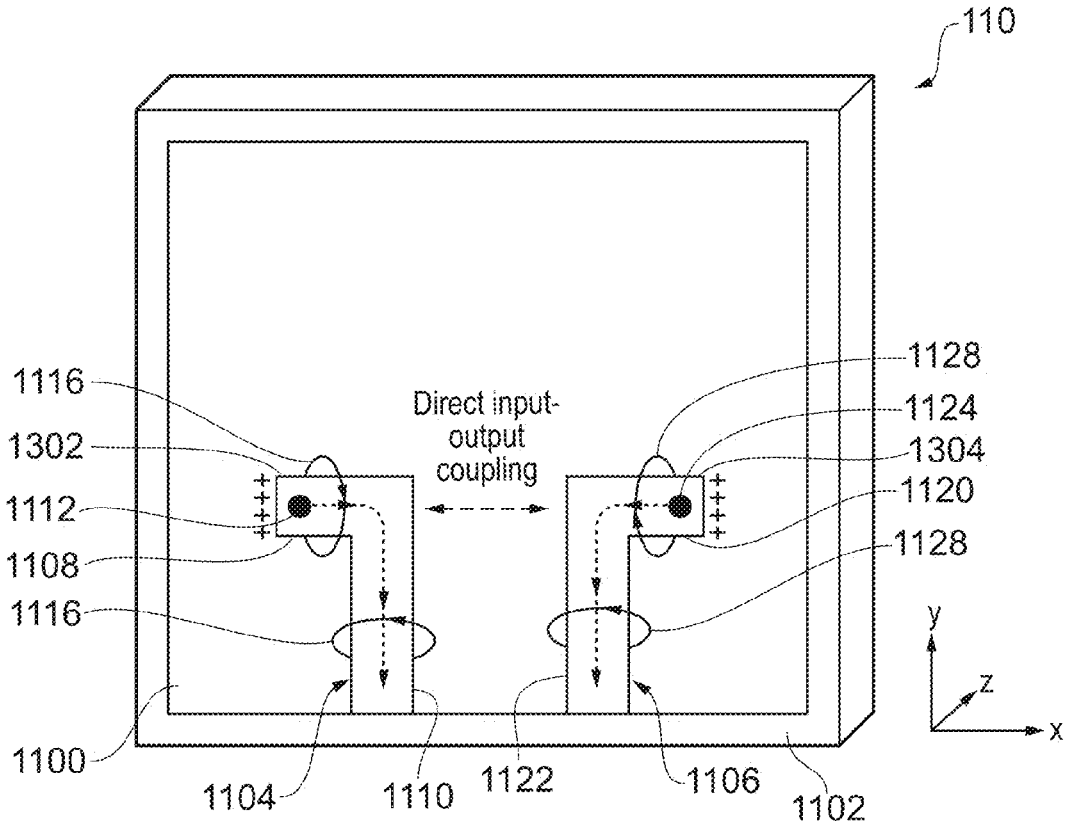
FIG. 13 is a schematic view of a second arrangement of couplings on a multi-mode filter.

FIG. 13 shows the input and output coupling tracks 1104, 1106 of the resonator body 110 in an alternative arrangement to that shown in FIG. 11. Like features are given like references.

In the arrangement shown in FIG. 13, the input and output coupling tracks 1104, 1106 are again generally L-shaped but, in contrast to the arrangement shown in FIG. 11, ends of the second sections 1110, 1122 are coupled to the metallised frame 1102. In this example, the feed-points 1112, 1124 are located towards ends 1302, 1304 of the first sections 1108, 1120 input and output coupling tracks 1104, 1106 respectively. Current flows through the coupling tracks 1104, 1106 in a direction from the feed-points 1112, 1124 towards the metallised frame 1102. Thus, the direction of current flow through the second sections 1110, 1122 of both coupling tracks 1104, 1106, is the same. However, the direction of current flowing through the first section 1108 of the input coupling track 1104 is opposite to the direction of current flowing that is induced through the first section 1120 of the output coupling track 1106. It will be appreciated, therefore, that the relative phases of the couplings from the input and output coupling tracks 1104, 1106 in the arrangement of FIG. 13 are the same as for the arrangement of FIG. 11.

Figure 14:
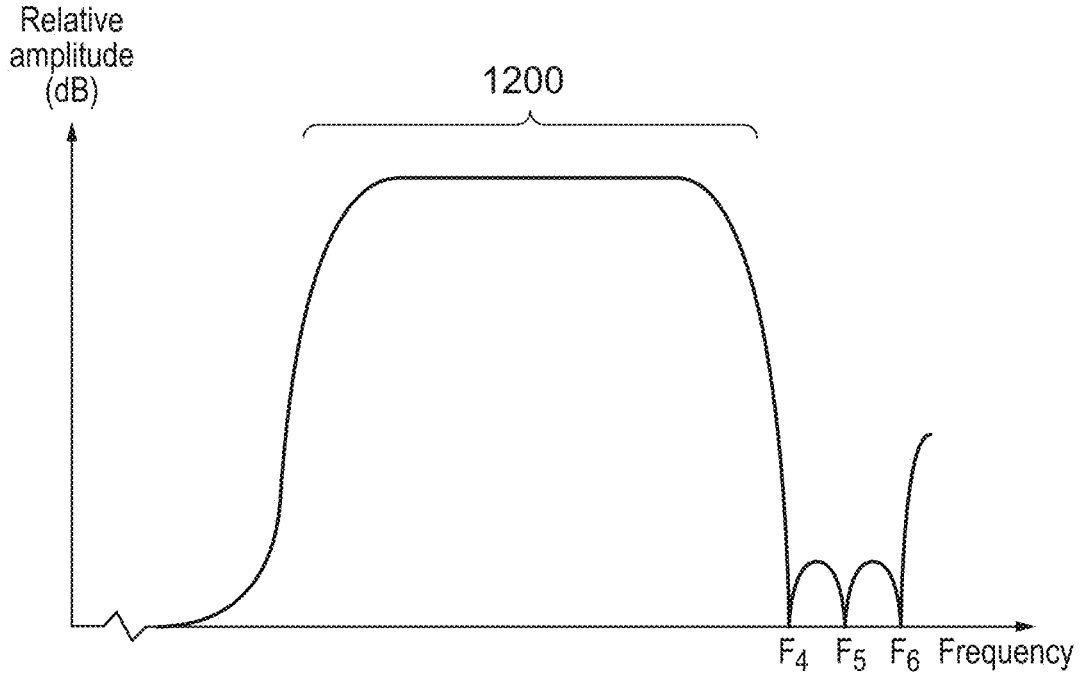
FIG. 14 is a plot of a filter response resulting from the arrangement shown in FIG. 13.

FIG. 14 shows a filter response of a filter incorporating the arrangement of couplings shown in FIG. 13. From this arrangement, zeros occur at frequencies $F_4$, $F_5$ and $F_6$, all of which are above the pass-band 1200. Thus, even though the relative phases of the couplings to each of the X, Y and Z-modes by the input and output coupling tracks 1104, 1106 are the same for the arrangements shown in FIGS. 11 and 13, the zeros occur at opposite sides of the pass-band in terms of frequency.

The relative phases of the coupling to each of the modes by the input and output coupling tracks (1104, 1106) are shown in Table 6.

TABLE 6

| Mode | Input coupling track phase | Output coupling track phase | Location of mode resonant frequency relative to the desired pass-band centre frequency | Phase of direct input-output coupling |
|---|---|---|---|---|
| X | + | − | Centre | + |
| Y | + | + | Top | |
| Z | + | + | Bottom | |

As is clear from Table 6, the central part of the pass-band 1200 shown in FIG. 14 results, as in the response shown in FIG. 12, from the excitation of the X-mode. However, in this example, the lower frequency part of the pass-band results this time from the excitation of the Z-mode, and the higher frequency part of the pass-band results this time from the excitation of the Y-mode.

With the input coupling track 1104 and the output coupling track 1106 being located on the same face of the resonator body 110, there is some degree of coupling between the input and output coupling tracks. Those skilled in the art will appreciate that, the further the distance between the input and output coupling tracks 1104, 1106, the lesser the degree of coupling therebetween and, similarly, the shorter the distance between the input and output coupling tracks, the greater the degree of coupling therebetween. Typically, filters of the kind discussed herein are of such a size that there will be an appreciable degree of coupling between the input and output coupling tracks 1104, 1106.

Referring again to FIG. 11, the input coupling track 1104 and the output coupling track 1106 are coupled at one end to the ground-plane frame 1102, and are uncoupled at their other ends. The point along each of the input and output coupling tracks 1104, 1106 where the current flow is at its peak, is where the track is coupled to the frame 1102 (the current anti-nodes). These are also the points at which the magnetic field around each coupling track is at a maximum. The electric field is a maximum at the uncoupled end 1118, 1130 of each of input and output coupling tracks 1104, 1106 (the voltage anti-nodes).

In the example shown in FIG. 11, the voltage anti-nodes (ends 1118 and 1130) of the input and output coupling tracks are closer to one another than the current anti-nodes (the point where the input and output coupling tracks are coupled to the metallised frame 1102). In that scenario, therefore, the electric field dominates over the magnetic field, so the coupling between the input coupling track 1104 and the output coupling track 1106 is predominantly an electric field coupling. However, in the example shown in FIG. 13, the current anti-nodes of the input and output coupling tracks are closer to one another than the voltage anti-nodes and, therefore, the magnetic field dominates, and the input-output coupling is predominantly magnetic field coupling. In both of those examples, the input and output coupling tracks are in phase with one another. That is to say, instantaneous currents flow in the same direction in both tracks.

An electric field dominated input-output coupling is opposite in phase to a magnetic field dominated input-output coupling, Thus, an electric field input-output coupling generates an inverse-phase ('−') coupling, and a magnetic field input-output coupling generates an in-phase ('+') coupling.

For example, in the arrangement shown in FIG. 11, where the electric field dominates, the input-output coupling is an inverse-phase (−) coupling, resulting in the third zero being located below the pass-band of the filter. In the arrangement shown in FIG. 13, where the magnetic field dominates, the input-output coupling is an in-phase (+) coupling, resulting in the third zero being located above the pass-band of the filter.

The distance between the input coupling track 1104 and the output coupling track 1106 determines the strength of the third transmission zero. Relatively close coupling of the tracks is a necessary condition to obtain a relatively strong zero; positioning the coupling tracks relatively far apart from one another will result in a relatively weak zero.

Figure 15:
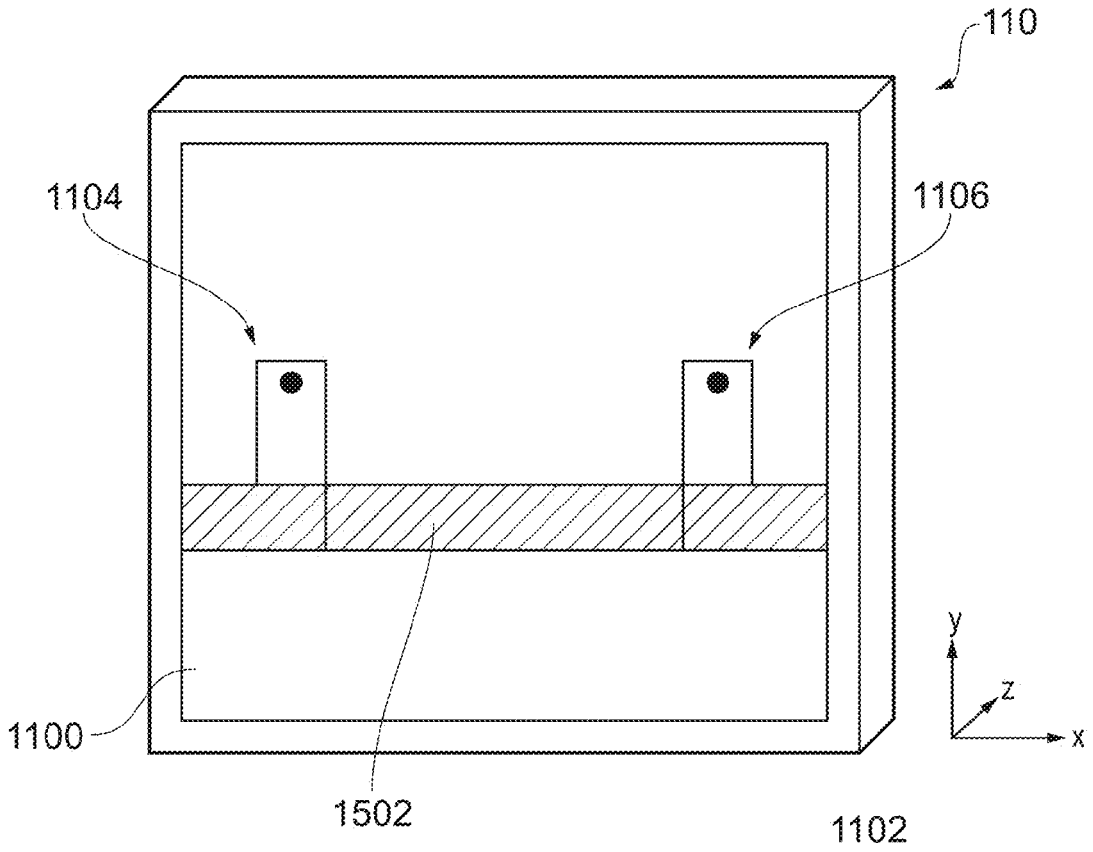
FIG. 15 is a schematic view of third arrangement of couplings on a multi-mode filter.

The degree of coupling between the input coupling track 1104 and the output coupling track 1106 can be increased by directly coupling the input and output coupling tracks to one another. This form of direct connection results in H-field input-output coupling and consequently a positive (+) coupling phase. This form of input-output coupling can be achieved by applying an input-output coupling track 1502 directly to the face 1100 of the resonator body 110, as in the embodiment shown in FIG. 15. However, such an additional coupling 1502 would also couple to one of the resonance modes of the resonator body 110. For example, an input-output coupling track 1502 formed applied between the input coupling track 1104 and the output coupling track 1106 as shown in FIG. 15 would couple, to some degree, to the X-mode of the resonator body 110. This additional coupling would have to be taken into account when designing the resonator body 110. An alternative way of coupling the input coupling track 1104 to the output coupling track 1106 without affecting the coupling to the resonance modes of the resonator body 110 is to provide an input-output coupling on a PCB to which the resonator body is to be attached, with the input-output coupling track being placed beneath a layer containing a ground-plane which forms the final side of the resonator body structure. In other words, the input-output coupling track is placed outside of the 'box' in which the resonator is contained and is coupled to the input and output coupling structures via small 'vias' or an equivalent mechanism which introduces minimal breaks in the coverage of the PCB ground-plane forming the final ($6^{th}$) side of the resonator body.

Figure 16:
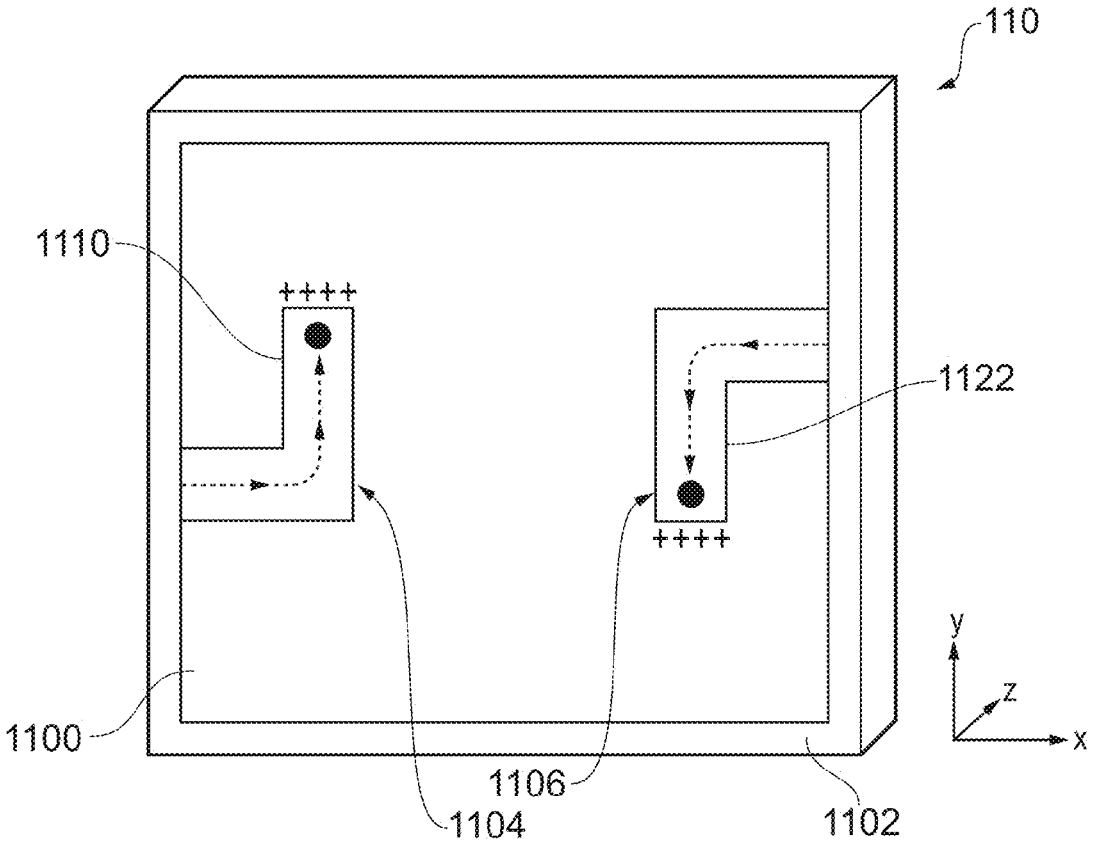
FIG. 16 is a schematic view of a fourth arrangement of couplings on a multi-mode filter.
Figure 17A:
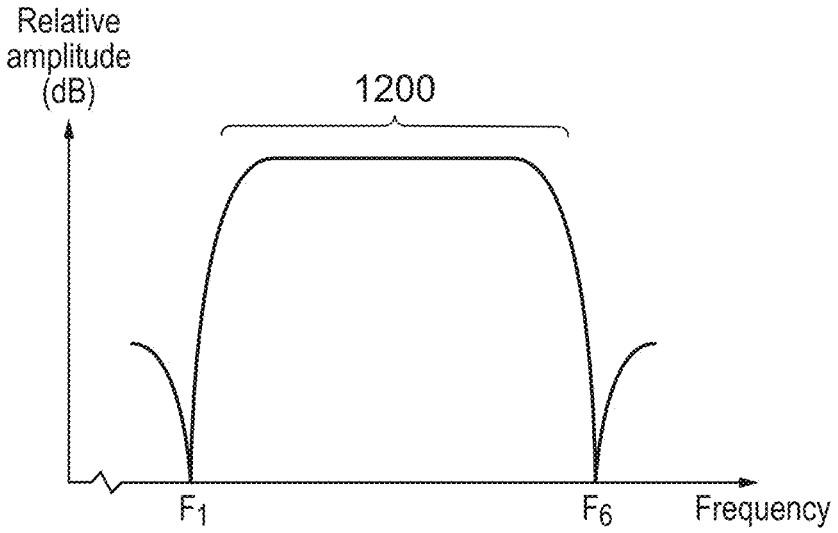
FIG. 17A is a plot of a filter response resulting from a first configuration of the arrangement shown in FIG. 16.

FIG. 16 shows an arrangement of input and output coupling tracks 1104, 1106 similar to that of FIG. 11. In this example, however, the output coupling 1106 is flipped about the X-axis relative to the output coupling of FIG. 11. The output coupling track 1106 is rotated 180° with respect to the input coupling track 1104 and, therefore, rotational symmetry exists between them. In this orientation, current flowing along the second section 1122 of the output coupling track 1106 is opposite in direction to the current flowing through the second section 1110 of the input coupling track 1104. Consequently, both the X-mode and Y-mode couplings of the output coupling track 1106 are out of phase with the X and Y-mode couplings of the input coupling track 1104. The coupling to the Z-mode of the input and output couplings 1104, 1106 remains in phase. That is to say, instantaneous electric fields occurring at both tracks 1104, 1106 are, predominantly, in the Z-direction. In this case the electric field coupling dominates, since the voltage anti-nodes are again closer together (as was the case in FIG. 11) and consequently the input-output coupling is an inverse-phase (−) coupling. If positive coupling is desired, it is necessary to add a direct input-output coupling track. The change in the orientation of the coupling structures, in this case, (relative to those in FIG. 11) is designed to alter the phase of the input-coupling via the Y mode. A filter response achieved from the arrangement of FIG. 16 is shown in FIG. 17A. A first zero occurs below the pass-band 1200 and a second zero occurs above the pass-band.

Figure 17B:
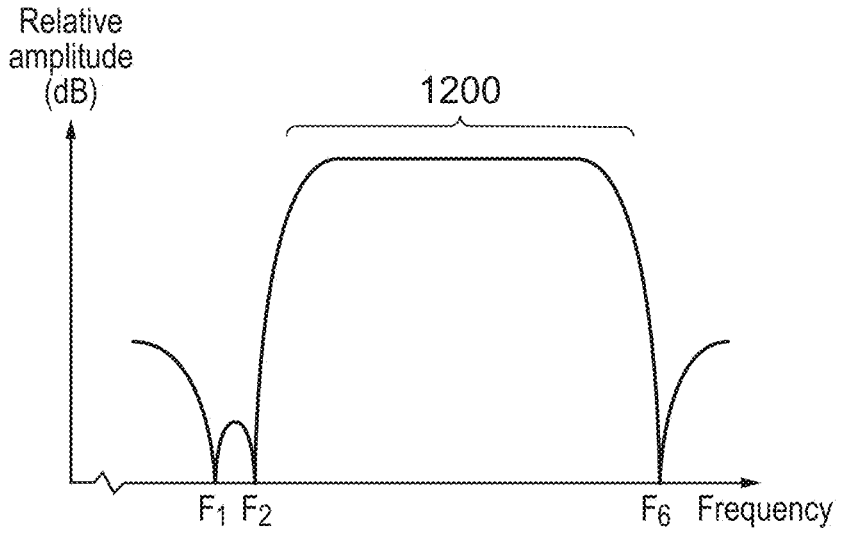
FIG. 17B is a plot of a filter response resulting from a second configuration of the arrangement shown in FIG. 16.

FIG. 17B shows a filter response for the arrangement of couplings shown in FIG. 16 in the scenario that the input and couplings 1104, 1106 are sufficiently close that some degree of input-output coupling occurs therebetween. As a result of the closer proximity of the voltage anti-nodes between the input and output coupling tracks, the E-field coupling will dominate and, therefore, the resulting input-output coupling is an inverse-phase (−) coupling. Consequently, the third zero occurs below the pass-band 1200. Thus, two zeros occur at frequencies $F_1$ and $F_2$ below the pass-band 1200, and a single zero occurs at a frequency $F_6$ above the pass-band.

The relative phases of the coupling to each of the modes by the input and output coupling tracks (1104, 1106) are shown in Table 7.

TABLE 7

| Mode | Input coupling track phase | Output coupling track phase | Location of mode resonant frequency relative to the desired pass-band centre frequency | Phase of direct input-output coupling |
|---|---|---|---|---|
| X | + | − | Bottom | − |
| Y | + | − | Top | |
| Z | + | + | Centre | |

As is clear from Table 7, both the X and Y-mode couplings of the output coupling track 1106 are out of phase with the X and Y mode couplings of the input coupling track 1104, causing a first zero to occur below the pass-band 1200 (at frequency $F_1$) and a second zero to occur above the pass-band (at frequency $F_6$). As is noted above, since an electric field dominates the input-output coupling, the third zero occurs below the pass-band 1200. FIG. 18A shows a filter response of a filter having the arrangement of couplings of FIG. 11 or 13, assuming no (or a negligible amount of) input-output coupling is present. In this arrangement, the locations of the mode resonant frequencies relative to the pass-band centre frequency are the same as those shown in Table 5. Since there is no input-output coupling, no third zero is present. The two zeros occur below the pass-band.

Figure 18B:
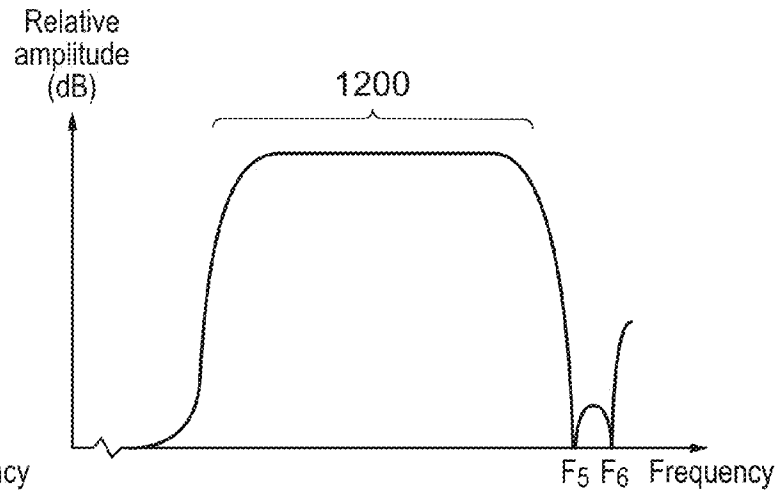
FIG. 18B is a plot of a filter response resulting from the arrangements shown in FIG. 11 or FIG. 13.
Figure 18A:
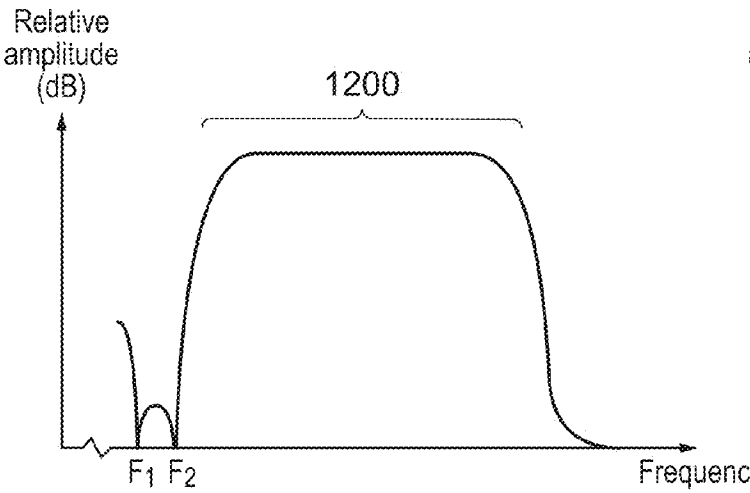
FIG. 18A is a plot of a filter response resulting from the arrangements shown in FIG. 11 or FIG. 13.

FIG. 18B shows a filter response of a filter having the arrangement of couplings of FIG. 11 or 13, assuming no (or a negligible amount of) input-output coupling is present. In this arrangement, the locations of the mode resonant frequencies relative to the pass-band centre frequency are the same as those shown in Table 6. That is to say, the locations of the X and Y-mode resonant frequencies are reversed with respect to the arrangement of Table 5. Since no input-output coupling is present, no third zero is present. The two zeros occur above the pass-band.

Figure 18D:
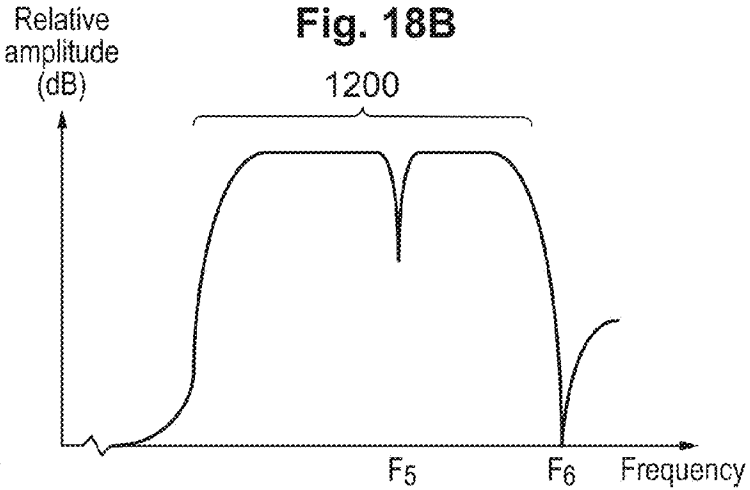
FIG. 18D is a plot of a filter response resulting from the arrangement shown in FIG. 16.
Figure 18C:
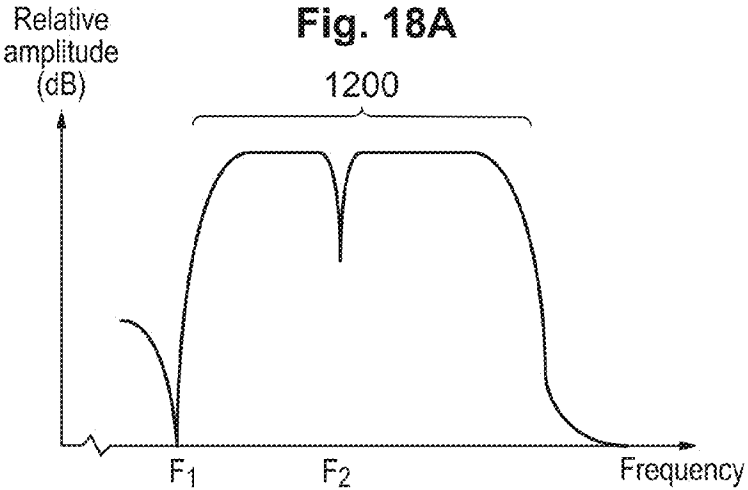
FIG. 18C is a plot of a filter response resulting from the arrangement shown in FIG. 16.

FIG. 18C shows a filter response of a filter having the arrangement of couplings of FIG. 16, assuming no (or a negligible amount of) input-output coupling is present. In this arrangement, the locations of the mode resonant frequencies relative to the pass-band centre frequency are the same as those shown in Table 5. Since there is no input-output coupling, no third zero is present. A first zero occurs below the pass-band, and a second zero occurs at a frequency falling within the pass-band, causing a sharp trough in the response.

FIG. 18D shows a filter response of a filter having the arrangement of couplings of FIG. 16, assuming no (or a negligible amount of) input-output coupling is present. In this arrangement, the locations of the mode resonant frequencies relative to the pass-band centre frequency are the same as those shown in Table 6. That is to say, the locations of the X and Y-mode resonant frequencies are reversed with respect to the arrangement of Table 5. Since no input-output coupling is present, no third zero is present. A first zero occurs at a frequency falling within the pass-band, causing a sharp trough in the response, and a second zero occurs above the pass-band.

The above described examples have focused on coupling to up to three modes. It will be appreciated this allows coupling to be to low order resonance modes of the resonator body. However, this is not essential, and additionally or alternatively coupling could be to higher order resonance modes of the resonator body.

The above examples include coupling structures including conductive coupling paths. It will be appreciated that, in practice, the degree of coupling between such a path (or an element of one) and its associated resonator body will vary as a function of the frequency of the electrical signal that is conveyed by the path (or the element) and that there will be a resonant peak in the degree of coupling at some frequency that is dependent on the shape and dimensions of the path (or the element). If such a path (or element) is arranged to convey an electrical signal at that resonant frequency, then it is reasonable to term the path (or element) a "resonator". Indeed, the path 431 in FIG. 4B is referred to a quarter wave resonator, the resonant frequency being determined by the length of the path 431.

In the examples described above, a cuboid resonator body 110 is used. Such a resonator body enables coupling of up to three resonance modes. However, as will be apparent to those skilled in the art, a resonator body of a different three-dimensional shape may provide a different number of degenerate resonance modes. For example, a rectangular cuboid resonator body (that is a 2:2:1 ratio cuboid) has four degenerate resonance modes. Thus, filters can be designed having one or more resonator bodies or the same or different shapes, depending on the required characteristics of the filter.

Moreover, characteristics of a filter may be chosen by applying defects to the resonator body. Such defects may include shaving a particular amount of dielectric material from an edge of the resonator body, or drilling one or more holes of a particular size into the body.

In some scenarios, a single resonator body cannot provide adequate performance (for example, attenuation of out of band signals). In this instance, filter performance can be improved by providing two or more resonator bodies arranged in series, to thereby implement a higher-performance filter.

In one example, this can be achieved by providing two resonator bodies in contact with each other, with one or more apertures provided in the silver coatings of the resonator bodies, where the bodies are in contact. This allows the fields in each cube to enter the adjacent cube, so that a resonator body can receive a signal from or provide a signal to another resonator body. When two resonator bodies are connected, this allows each resonator body to include only a single coupling array, with a coupling array on one resonator body acting as an input and the coupling array on the other resonator body acting as an output. Alternatively, the input of a downstream filter can be coupled to the output of an upstream filter using a suitable connection such as a short transmission line.

The above described examples have focused on coupling to up to four modes. It will be appreciated this allows coupling to be to low order resonance modes of the resonator body. However, this is not essential, and additionally or alternatively coupling could be to higher order resonance modes of the resonator body.

Persons skilled in the art will appreciate that numerous variations and modifications will become apparent. All such variations and modifications which become apparent to persons skilled in the art are considered to fall within the spirit and scope of the invention broadly appearing before described.

The invention claimed is:

1. A multi-mode dielectric filter comprising:

a dielectric body having at least first and second orthogonal resonant modes;

a first coupling element formed on a first face of the dielectric body for coupling energy to at least a first resonant mode, said first face having a lengthwise direction and a widthwise direction; and a second coupling element formed on the first face of the dielectric body for coupling energy from at least the first resonant mode;

wherein said dielectric body is continuously covered on all sides, except for said first face, with a layer of conductive material, said first coupling element and said second coupling element being electrically connected to said layer of conductive material at a first point and a second point, respectively, and extending on said first face in both said lengthwise direction and said widthwise direction to a first end and a second end, respectively, said first coupling element having a first orientation on said first face and said second coupling element having a second orientation on said first face;

so that the dielectric body supports a first coupling path between the first coupling element and the second coupling element via the first resonant mode; and so that the dielectric body supports a second coupling path between the first coupling element and the second coupling element via the second resonant mode, the second coupling path being such that at least partial cancellation of at least some coupled energy takes place so as to form at least one zero in a response of the filter, wherein relative positions of said first point and said second point, and of said first end and said second end, and the relative orientations of said first coupling element and said second coupling element to one another determine relative phases and strengths of the first and second coupling paths, thereby enabling zeros in a response of the multi-mode dielectric filter to be obtained at desired locations relative to poles in the response.

2. A filter according to claim 1, wherein the first coupling element comprises a first portion having a longitudinal axis extending in a first direction, and a second portion having a longitudinal axis extending in a second direction.

3. A filter according to claim 2, wherein the second direction is substantially orthogonal to the first direction.

4. A filter according to claim 1, wherein the second coupling element comprises a third portion having a longitudinal axis extending in a first direction, and a fourth portion having a longitudinal axis extending in a second direction.

5. A filter according to claim 1, wherein the first coupling element comprises a first portion having a longitudinal axis extending in a first direction, and a second portion having a longitudinal axis extending in a second direction, and wherein the second coupling element comprises a third portion having a longitudinal axis extending parallel to the first direction, and a fourth portion having a longitudinal axis extending parallel to the second direction.

6. A filter according to claim 1, wherein the first coupling element comprises a first portion having a longitudinal axis extending in a first direction, and a second portion having a longitudinal axis extending in a second direction, and wherein the second coupling element comprises a third portion having a longitudinal axis extending perpendicular to the first direction, and a fourth portion having a longitudinal axis extending parallel to the second direction.

7. A filter according to claim 1, wherein the first coupling element comprises a first portion having a longitudinal axis extending in a first direction, and a second portion having a longitudinal axis extending in a second direction, and wherein the second coupling element comprises a third portion having a longitudinal axis extending parallel to the first direction, and a fourth portion having a longitudinal axis extending perpendicular to the second direction.

8. A filter according to claim 1, wherein the dielectric body is a three-dimensional body having at least two faces that include said first face, and the second and subsequent faces are covered by a metallic layer.

9. A filter according to claim 1, wherein the first coupling element, in use, is a resonant element.

10. A base station comprising a filter, the filter having the features of claim 1.

11. A filter according to claim 1, wherein the dielectric body supports the second coupling path between the first coupling element and the second coupling element via a third resonant mode.

12. A filter according to claim 1, wherein the first and second coupling elements are tracks.

13. A filter according to claim 12, wherein a first end of at least one of the tracks is coupled to a ground-plane.

14. A filter according to claim 13, wherein a second end of at least one of the tracks is configured to couple energy to a third resonant mode of the resonator body.

15. A filter according to claim 13, wherein each track includes a signal feed-point.

16. A filter according to claim 1, wherein the first coupling element and the second coupling element are substantially L-shaped.

17. A filter according to claim 1, further comprising a third coupling element for coupling the first coupling element to the second coupling element.

18. A filter according to claim 1, wherein the at least first and second orthogonal resonant modes include has first, second and third orthogonal resonant modes, the first mode being an X-mode, the second mode being a Y-mode and the third mode being a Z-mode.

19. A filter according to claim 1, wherein the at least first and second orthogonal resonant modes include has first, second and third orthogonal resonant modes;

wherein a third coupling path can exist between the first coupling element and the second coupling element predominantly via at least the third resonant mode; and wherein a fourth coupling path can exist predominantly directly between the first coupling element and the second coupling element.

20. A filter according to claim 1, further comprising a second dielectric body coupled in series with the dielectric body.

21. A method of designing a multi-mode dielectric filter, the filter comprising a dielectric body having at least first and second orthogonal resonant modes, the method comprising:

providing a first coupling element on a first face of the dielectric body for coupling energy to at least a first resonant mode, said first face having a lengthwise direction and a widthwise direction; and providing a second coupling element on the first face of the dielectric body for coupling energy from at least the first resonant mode;

wherein said dielectric body is continuously covered on all sides, except for said first face, with a layer of conductive material, said first coupling element and said second coupling element being electrically connected to said layer of conductive material at a first point and a second point, respectively, and extending on said first face in both said lengthwise direction and said widthwise direction to a first end and a second end, respectively, said first coupling element having a first orientation on said first face and said second coupling element having a second orientation on said first face;

so that a first coupling path exists between the first coupling element and the second coupling element via the first resonant mode; and so that a second coupling path exists between the first coupling element and the second coupling element via the second resonant mode, the second coupling path being such that at least partial cancellation of at least some coupled energy takes place so as to form at least one zero in a response of the filter, wherein relative positions of said first point and said second point, and of said first end and said second end, and the relative orientations of said first coupling element and said second coupling element to one another determine relative phases and strengths of the first and second coupling paths, thereby enabling zeros in a response of the multi-mode dielectric filter to be obtained at desired locations relative to poles in the response.

22. A method according to claim 21, further comprising the step of:

providing a third coupling element for coupling the first coupling element to the second coupling element.

* * * * *